US008792804B2

(12) United States Patent
Kamimura

(10) Patent No.: US 8,792,804 B2
(45) **Date of Patent: *Jul. 29, 2014**

(54) IMAGE FORMING DEVICE HAVING SHUTTER DRIVING MEMBER

(75) Inventor: Naoya Kamimura, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 414 days.

This patent is subject to a terminal disclaimer.

(21) Appl. No.: 13/072,738

(22) Filed: Mar. 27, 2011

(65) Prior Publication Data

US 2011/0299880 A1 Dec. 8, 2011

(30) Foreign Application Priority Data

Jun. 3, 2010 (JP) ..... 2010-128150

(51) Int. Cl.
*G03G 15/08* (2006.01)

(52) U.S. Cl.
CPC ..... *G03G 15/0836* (2013.01); *G03G 2215/067* (2013.01)
USPC ..... 399/110; 399/107; 399/258

(58) Field of Classification Search
USPC ..... 399/258, 112, 99, 102, 106, 107, 110, 399/113, 120, 255, 260, 262, 263
See application file for complete search history.

(56) References Cited

U.S. PATENT DOCUMENTS 6,151,459 A * 11/2000 Hashimoto et al. ..... 399/27
6,185,401 B1 2/2001 Kanamori et al.
6,766,133 B1 7/2004 Ban et al.
2004/0131391 A1 7/2004 Nagashiro
2005/0271425 A1* 12/2005 Shimomura et al. ..... 399/258
2009/0087225 A1 4/2009 Sakuma
2009/0129813 A1 5/2009 Nagashima et al.
2009/0180802 A1* 7/2009 Sato et al. ..... 399/119
2009/0297209 A1 12/2009 Nakajima et al.
2009/0297226 A1 12/2009 Nagashima et al.

(Continued)

FOREIGN PATENT DOCUMENTS

JP H03-037686 A 2/1991
JP H03-175471 A 7/1991

(Continued)

OTHER PUBLICATIONS

Kidosaki et al., JP 2009-086417 A, "Electro-photographic image forming device" Apr. 23, 2009.*

(Continued)

*Primary Examiner* — Walter L Lindsay, Jr.
*Assistant Examiner* — Matthew Miller
(74) *Attorney, Agent, or Firm* — Baker Botts L.L.P.

(57) ABSTRACT

An image forming device includes a plurality of image bearing members, a plurality of developing units, a plurality of toner cartridges, a plurality of shutter driving members, a driving force generating member that generates a driving force, and a driving force transmitting mechanism that transmits the driving force to the shutter driving members. Each toner cartridge includes a casing formed with an opening through which toner accommodated in the casing is supplied to the corresponding developing unit and a shutter movable between an opening position at which the shutter opens the opening and a closing position at which the shutter closes the opening. Each of the shutter driving members moves the corresponding shutter between the opening position and the closing position when supplied with the driving force.

12 Claims, 25 Drawing Sheets

(56) References Cited

U.S. PATENT DOCUMENTS

| | | | | |
|---|---|---|---|---|
| 2011/0299879 | A1* | 12/2011 | Kamimura | 399/110 |
| 2012/0033988 | A1* | 2/2012 | Itabashi | 399/106 |
| 2012/0170954 | A1 | 7/2012 | Sakuma | |

FOREIGN PATENT DOCUMENTS

| | | | | | |
|---|---|---|---|---|---|
| JP | H06-035321 | A | | 2/1994 | |
| JP | H10-020746 | A | | 1/1998 | |
| JP | H11-194600 | A | | 7/1999 | |
| JP | H11-272050 | A | | 10/1999 | |
| JP | 2000-275945 | A | | 10/2000 | |
| JP | 2004-205587 | A | | 7/2004 | |
| JP | 2004-333608 | A | | 11/2004 | |
| JP | 2005-031109 | A | | 2/2005 | |
| JP | 2005-338583 | A | | 12/2005 | |
| JP | 2006-243763 | A | | 9/2006 | |
| JP | 2006-267607 | A | | 10/2006 | |
| JP | 2007-178971 | A | | 7/2007 | |
| JP | 2008-233841 | A | | 10/2008 | |
| JP | 2009-086149 | A | | 4/2009 | |
| JP | 2009-086417 | A | | 4/2009 | |
| JP | 2009-288473 | A | | 12/2009 | |
| JP | 2012037555 | A | * | 2/2012 | G03G 15/08 |

OTHER PUBLICATIONS

Japan Patent Office, Office Action for Japanese Patent Application No. 2010-128150 (counterpart to above-captioned patent application), mailed Mar. 27, 2012.

Japan Patent Office, Office Action for Japanese Patent Application No. 2010-128151 (counterpart to above-captioned patent application), mailed Mar. 27, 2012.

State Intellectual Property Office of the People's Republic of China, The First Office Action for Chinese Patent Application No. 201110084873.1 (counterpart Chinese patent application), mailed Oct. 29, 2012.

State Intellectual Property Office of the People's Republic of China, The First Office Action for Chinese Patent Application No. 201110084875.0 (counterpart Chinese patent application), mailed Oct. 29, 2012.

* cited by examiner

IMAGE FORMING DEVICE HAVING SHUTTER DRIVING MEMBER

CROSS REFERENCE TO RELATED APPLICATION

This application claims priority from Japanese Patent Application No. 2010-128150 filed Jun. 3, 2010. The entire content of this priority application is incorporated herein by reference.

TECHNICAL FIELD

The present invention relates to an image forming device, such as a laser printer.

BACKGROUND

There has been provided a laser printer as an example of an image forming device that includes a process unit detachably mounted in a main casing and a toner cartridge mounted on the process unit. The process unit supports a photosensitive drum and a developing unit, and the toner cartridge accommodates toner.

For example, the toner cartridge includes an inner cylindrical member for accommodating toner and an outer cylindrical member for rotatably accommodating the inner cylindrical member. Both of the inner and outer cylindrical members are formed with through holes in their peripheral walls, and a handle is formed on an end face of the inner cylindrical member. The user can manipulate the handle to move (rotate) the inner cylindrical member between an opening position where the hole formed in the inner cylindrical member is opposite to the hole formed in the outer cylindrical member and a closing position where the hole formed in the inner cylindrical member is not opposite to the hole formed in the outer cylindrical member.

When the toner cartridge is detached from the process unit, the inner cylindrical member is at the closing position, and an inner peripheral surface of the outer cylindrical member opposes the hole formed in the inner cylindrical member. Thus, a fluid communication between interior and exterior of the inner cylindrical member is blocked, and toner is prevented from leaking out of the inner cylindrical member.

When the toner cartridge is mounted onto the process unit, the user manipulates the handle to rotate the inner cylindrical member to the opening position. As a result, the interior of the inner cylindrical member is brought into fluid communication with the exterior thereof, and toner accommodated in the inner cylindrical member is supplied to the developing unit.

When the toner cartridge runs out of toner, the toner cartridge is detached from the process unit for replacement after the user manipulates the handle to rotate the inner cylindrical member to the closing position.

SUMMARY

As described above, a user is required to manually rotate the inner cylindrical member by operating the handle when attaching and detaching the toner cartridge to or from the process unit, which is troublesome for the user.

In view of the foregoing, it is an object of the invention to provide an image forming device that reduces burden on a user when attaching or detaching a toner cartridge to or from a support member.

In order to attain the above and other objects, the invention provides an image forming device including a main casing, a support member movable in a predetermined direction relative to the main casing between an accommodated position within the main casing and a pulled-out position outside the main casing, a plurality of image bearing members supported on the support member and aligned in a line at intervals in the predetermined direction, a plurality of developing units provided in one-to-one correspondence with the plurality of image bearing members and supported on the support member, a plurality of toner cartridges provided in one-to-one correspondence with the plurality of developing units and detachably mounted on the support member, a plurality of shutter driving members provided in one-to-one correspondence with the plurality of toner cartridges, a driving force generating member that is disposed in the main casing and that generates a driving force, and a driving force transmitting mechanism that is disposed on the support member and that transmits the driving force generated by the driving force generating member to the shutter driving members. Each of the toner cartridges includes a casing formed with an opening through which toner accommodated in the casing is supplied to a corresponding one of the developing units and a shutter movable between an opening position at which the shutter opens the opening and a closing position at which the shutter closes the opening. Each of the shutter driving members moves the shutter of a corresponding one of the toner cartridges between the opening position and the closing position when supplied with the driving force.

According to another aspect, the present invention provides an image forming device including a main casing, a moving member, a plurality of toner cartridges, a plurality of shutter driving members, a driving force generating member, and a driving force transmitting mechanism. The moving member is movable in a predetermined direction relative to the main casing between an inside position within the main casing and an outside position outside the main casing. The moving member holds a plurality of developing units aligned in a line at intervals in the predetermined direction. The plurality of toner cartridges is provided in one-to-one correspondence with the plurality of developing units and detachably mounted on the moving member. Each of the toner cartridges includes a casing formed with an opening through which toner accommodated in the casing is supplied to a corresponding one of the developing units and a shutter movable between an opening position at which the shutter opens the opening and a closing position at which the shutter closes the opening. The plurality of shutter driving members is provided in one-to-one correspondence with the plurality of toner cartridges. Each of the shutter driving members moves the corresponding shutter between the opening position and the closing position when supplied with a driving force. The driving force generating member is disposed in the main casing and that generates the driving force. The driving force transmitting mechanism is disposed on the moving member and that transmits the driving force generated by the driving force generating member to the shutter driving members.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
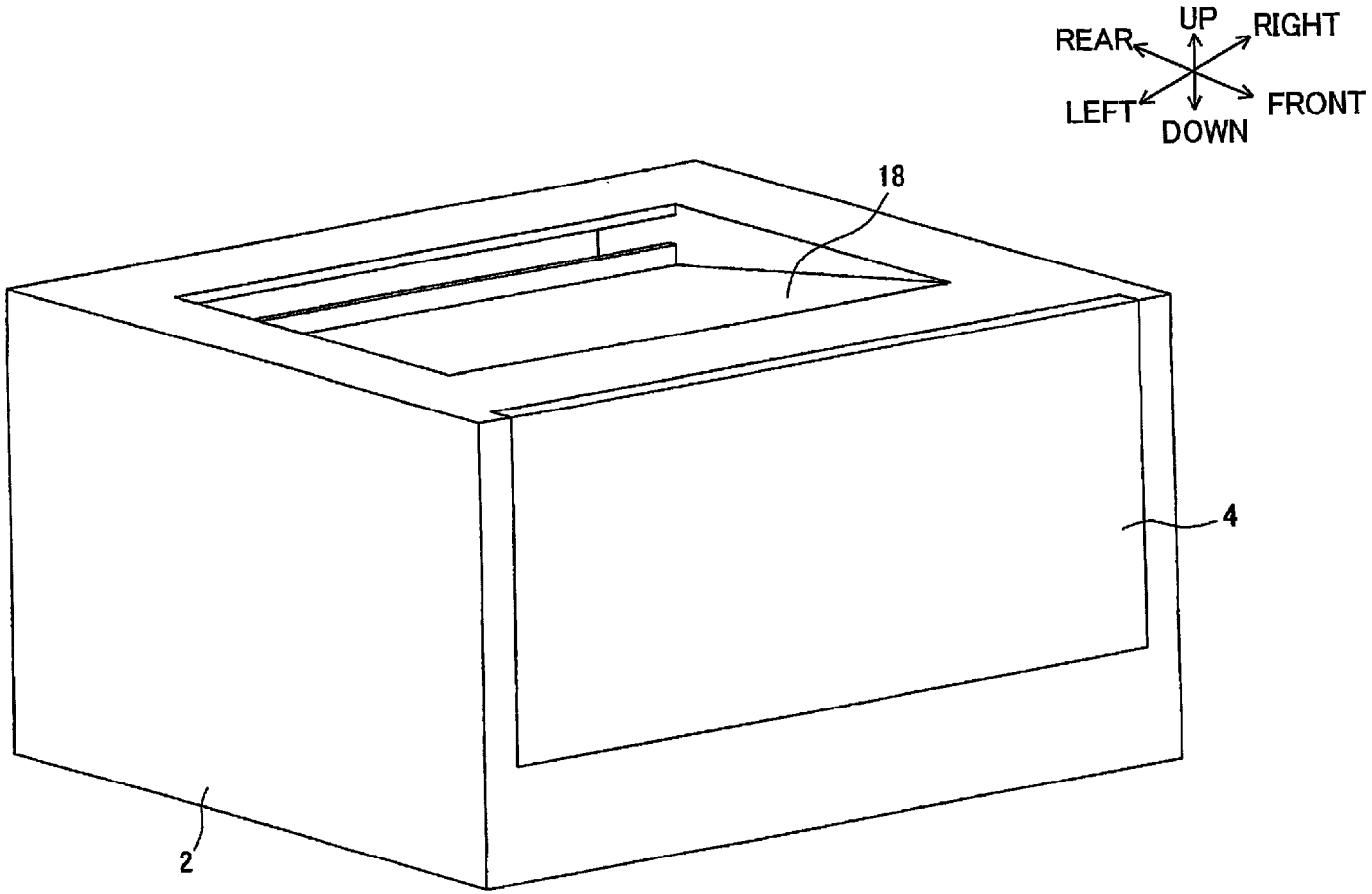
FIG. 1 is a perspective view of a color laser printer according to a first embodiment of the invention.

Image forming devices according to embodiments of the invention will be described while referring to the accompanying drawings wherein like parts and components are designated by the same reference numerals to avoid duplicating description.

<First Embodiment>

A color laser printer 1 as an image forming device according to a first embodiment of the invention will be described with reference to FIGS. 1 to 13B.

Figure 2:
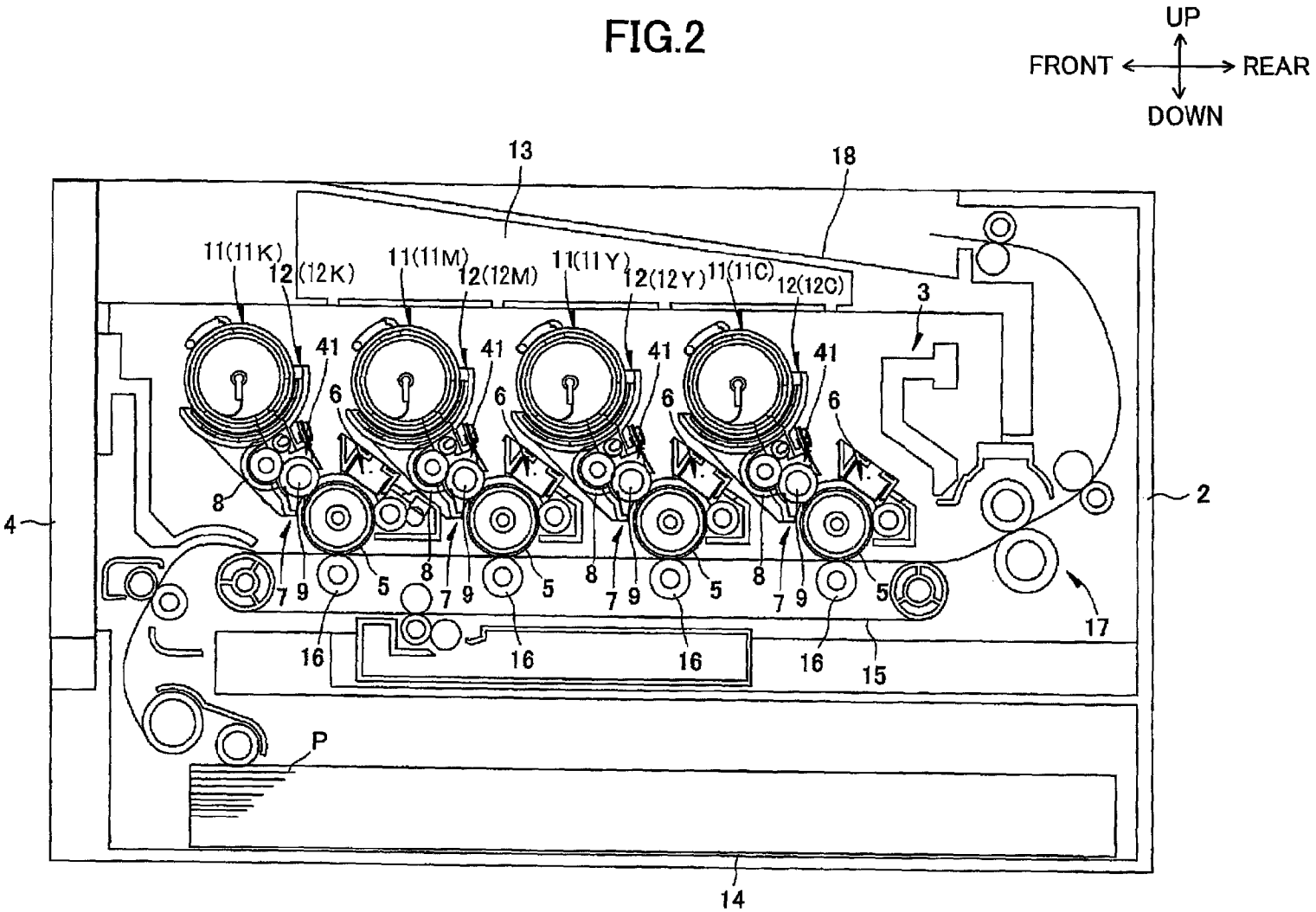
FIG. 2 is a cross-sectional right side view of the color laser printer of FIG. 1.

As shown in FIG. 1, the color laser printer 1 includes a main casing 2. As shown in FIG. 2, the main casing 2 accommodates a drawer unit 3. The main casing 2 is formed with a front cover 4 that can be selectively opened and closed. The drawer unit 3 can move in a front-rear direction (horizontal direction) relative to the main casing 2 between an accommodated position (inside position) shown in FIG. 2 and a pulled-out position (outside position) outside the main casing 2 when the front cover 4 is open.

Note that the terms "upward," "downward," "upper," "lower," "above," "below," "beneath," "right," "left," "front," "rear" and the like will be used throughout the description assuming that the color laser printer 1 is disposed in an orientation in which it is intended to be used and that the drawer unit 3 and toner cartridges 11 (described later) mounted thereon are accommodated in the main casing 2, unless defined otherwise. In use, the color laser printer 1 is disposed as shown in FIG. 1. The left and right sides of the main casing 2 will be based on the perspective of a user looking at the color laser printer 1 from the front side.

As shown in FIG. 2, the color laser printer 1 is a tandem-type color laser printer, and also includes four photosensitive drums (image-bearing members) 5, four chargers 6 in one-to-one correspondence with the photosensitive drums 5, and four developing units 7 in one-to-one correspondence with the photosensitive drums 5.

The drawer unit 3 supports the four photosensitive drums 5 such that the photosensitive drums 5 can rotate about respective rotary shafts extending along a right-left direction. The four photosensitive drums 5 are provided for respective colors black (K), yellow (Y), magenta (M), and cyan (C), and are aligned at fixed intervals in the front-rear direction. The order of the photosensitive drums 5 arranged from front to rear in this embodiment are for black, yellow, magenta, and cyan.

The drawer unit 3 also supports the four chargers 6 and the four developing units 7. The chargers 6 are disposed diagonally rearward and upward of the respective photosensitive drums 5. Each charger 6 is a Scorotron charger including a wire and a grid. The developing units 7 are disposed diagonally frontward and upward of the respective photosensitive drums 5. Each developing unit 7 includes a developing frame 8 and a developing roller 9 accommodated in the developing frame 8. The developing roller 9 is disposed rotatable about a rotary shaft extending along the right-left direction and in contact with the corresponding photosensitive drum 5.

In the drawer unit 3, four spaces 12 are defined at positions above each developing unit 7 for accommodating the respective toner cartridges 11 that accommodate toner. The toner cartridges 11 are accommodated into the corresponding spaces 12 from above when the drawer unit 3 is at the pulled-out position. The toner cartridge 11 supplies toner to the corresponding developing unit 7.

The toner cartridges 11 specifically include, in order from front to rear, a black toner cartridge 11K, a yellow toner cartridge 11Y, a magenta toner cartridge 11M, and a cyan toner cartridge 11C. Also, the spaces 12 specifically include, in order from front to rear, spaces 12K, 12Y, 12M, and 12C.

The color laser printer 1 also includes an exposing unit 13 accommodated in the main casing 2 at a position above the drawer unit 3. The exposing unit 13 irradiates four laser beams corresponding to each color.

A surface of each photosensitive drum 5 is uniformly charged by a discharge from the corresponding charger 6 as the photosensitive drum 5 rotates, and is then selectively exposed to the laser beam from the exposing unit 13. As a result, an electric potential on the surface of the photosensitive drum 5 is selectively lowered, thereby forming an electrostatic latent image on the surface of the photosensitive drum 5. When the electrostatic latent image is brought into confrontation with the corresponding developing roller 9, toner is selectively supplied onto the electrostatic latent image. As a result, a toner image is formed on the surface of the photosensitive drum 5.

Note that the color laser printer 1 may include four LED arrays, instead of the exposing unit 13.

The color laser printer 1 further includes a sheet supply cassette 14, a convey belt 15, four transfer rollers 16, and a fixing unit 17. The sheet supply cassette 14 is for accommodating paper sheets P and disposed in the bottom of the main casing 2. The paper sheets P accommodated in the sheet supply cassette 14 are conveyed one at a time onto the convey belt 15 by various rollers. The convey belt 15 is opposite to the four photosensitive drums 5 from below. The transfer rollers 16 are disposed in confrontation with the respective photosensitive drums 5 with an upper section of the convey belt 15 interposed therebetween. The paper sheet P conveyed onto the convey belt 15 is conveyed rearward by rotation of the convey belt 15 to pass through positions between the convey belt 15 and each photosensitive drum 5 in sequence. The toner image formed on the surface of each photosensitive drum 5 is transferred onto the paper sheet P when brought into confrontation therewith.

The fixing unit 17 is disposed on a downstream side of the convey belt 15 with respect to a sheet convey direction in which the paper sheet P is conveyed. The paper sheet P with toner images transferred thereon is conveyed to the fixing unit 17. The fixing unit 17 fixes the toner images onto the paper sheet P by heat and pressure. The paper sheet P with the toner images fixed thereon is discharged by various rollers onto a discharge tray 18 formed on an upper surface of the main casing 2.

Figure 3:
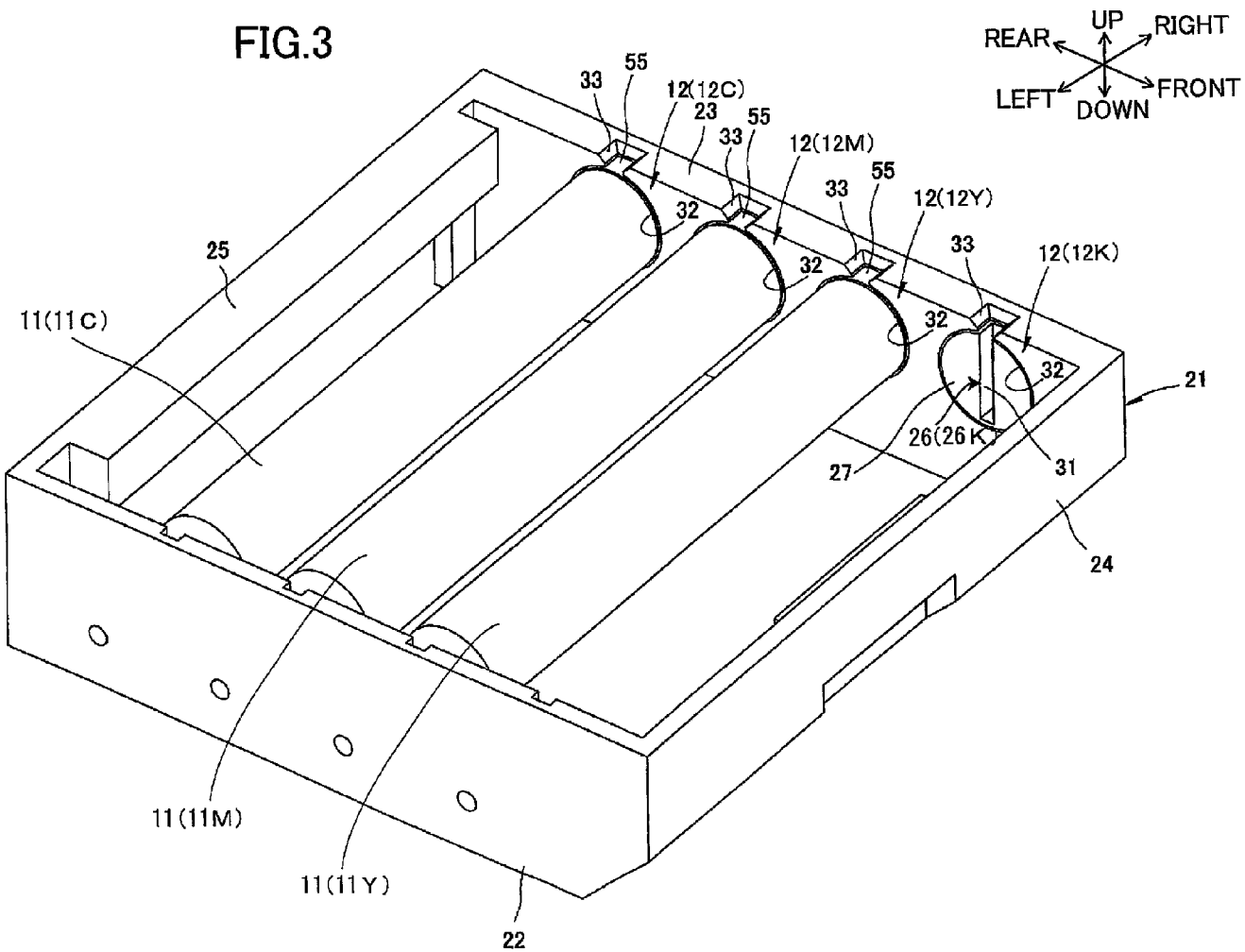
FIG. 3 is a perspective view of a drawer frame of the color laser printer of FIG. 1 with four toner cartridges mounted thereon.

As shown in FIG. 3, the drawer unit 3 includes a drawer frame (support member, moving member) 21. The drawer frame 21 includes a pair of left and right side plates 22 and 23 disposed in confrontation with each other with a gap defined therebetween in the right-left direction, a front beam 24 spanning between front ends of the side plates 22 and 23, and a rear beam 25 spanning between rear ends of the side plates 22 and 23, and is formed in a rectangular frame shape as a whole in a plan view.

The four photosensitive drums 5, the four chargers 6, and the four developing units 7 (FIG. 2) are all supported by and sandwiched between the side plates 22 and 23 on the left and right sides. The spaces 12 are defined between the side plates 22 and 23 at positions above the developing units 7. In other words, the side plates 22 and 23 support the chargers 6 and the developing units 7, and are opposite to each other in the right-left direction while defining a gap therebetween in the right-left direction for the spaces 12.

Figure 9:
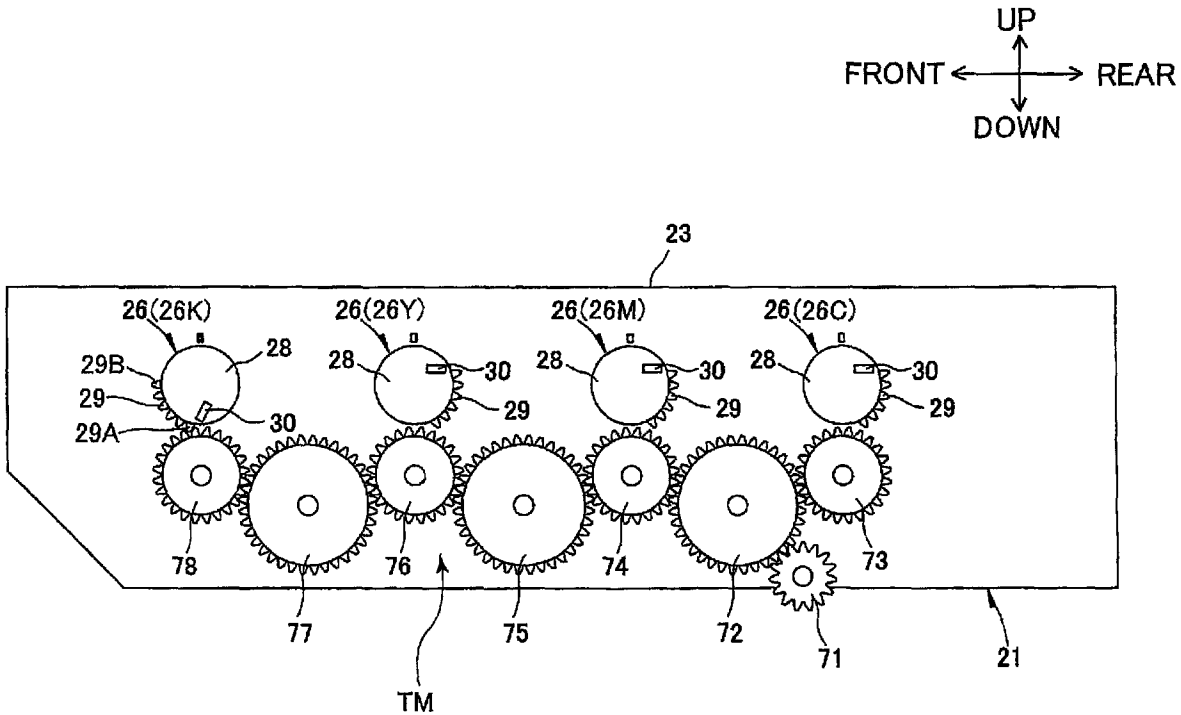
FIG. 9 is a right side view of the drawer frame of FIG. 3.

The right side plate 23 rotatably supports four shutter driving members 26 at positions opposing the respective spaces 12. As shown in FIG. 9, the shutter driving members 26 specifically include, in order from front to rear, shutter driving members 26K, 26Y, 26M, and 26C.

Figure 4:
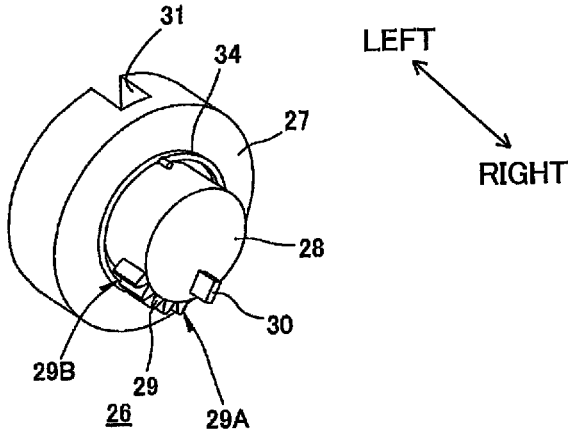
FIG. 4 is a perspective view of a shutter driving member according to the first embodiment of the invention.

As shown in FIG. 4, each shutter driving member 26 integrally includes a main part 27, a gear member 28, and a pressing member 30. The main part 27 is in a flat cylindrical shape. The gear member 28 is formed on a right surface of the main part 27 so as to project rightward therefrom. The gear member 28 is in a cylindrical shape with a smaller diameter than the main part 27. The pressing member 30 is in a rectangular shape and projects rightward from a right surface of the gear member 28. The gear member 28 is formed with a gear part 29 on a peripheral surface thereof. The gear part 29 is only formed in a range having a center angle of about 85 degrees. That is, the main part 27 is formed in a sector gear shape.

The main part 27 is formed with a guide groove 31 on a left surface thereof. The guide groove 31 extends straight along a radial direction of the main part 27 through a radial center thereof. The guide groove 31 does not completely penetrate through the main part 27 in the radial direction. As shown in FIG. 3, one side of the guide groove 31 in the radial direction is open, and the other is closed.

As shown in FIG. 3, the right side plate 23 is formed with four support holes 32 at positions opposite to the respective spaces 12. Each support hole 32 has a diameter slightly larger than the diameter of the main part 27 of the shutter driving member 26, and penetrates the right side plate 23 in the right-left direction. The shutter driving member 26 is supported in the corresponding support hole 32 such that the main part 27 is fit in the support hole 32, that the gear member 28 protrudes outside (rightward) from the right side plate 23, and that the left surface of the main part 27 formed with the guide groove 31 is substantially flush with an inner surface (left side surface) of the right side plate 23.

The right side plate 23 is also formed with four entrance ports 33 having a rectangular cross section in a plan view. Each entrance port 33 is a groove formed in the inner surface of the right side plate 23, and penetrates in the up-down direction a part of the right side plate 23 between an upper surface thereof and an upper edge of the support hole 32. With this configuration, when the shutter driving member 26 is in an orientation that the guide groove 31 extends in the up-down direction, the entrance port 33 aligns and fluidly communicates with the guide groove 31 in the up-down direction. The entrance port 33 has a width in the front-rear direction that is substantially the same as the width of the guide groove 31 at the bottom and that grows wider toward the top.

When the shutter driving member 26 is in an orientation that the guide groove 31 extends in the up-down direction as the shutter driving member 26K shown in FIG. 3, then as shown in FIG. 9 the pressing member 30 of the shutter driving member 26 is in a slant orientation at a lowest position (see the shutter driving member 26K), and one end 29A of the gear part 29 is in engagement with corresponding one of a second relay gear 73, a third relay gear 74, a fifth relay gear 76, and a seventh relay gear 78 to be described later, and the other end 29B is located frontward of the one end 29A.

As shown in FIG. 4, a wire spring 34 is wound on the periphery of the gear member 28. The wire spring 34 has one end fixed to the right side plate 23 and the other end fixed on the periphery of the gear member 28. With this configuration, the shutter driving member 26 is urged in a counterclockwise direction in a right side view by resilient force of the wire spring 34.

As shown in FIG. 2, the developing frames 8 are aligned at fixed intervals along the front-rear direction and span between the side plates 22 and 23. The spaces 12 for accommodating the toner cartridges 11 are partitioned by the developing frames 8.

Figure 5A:
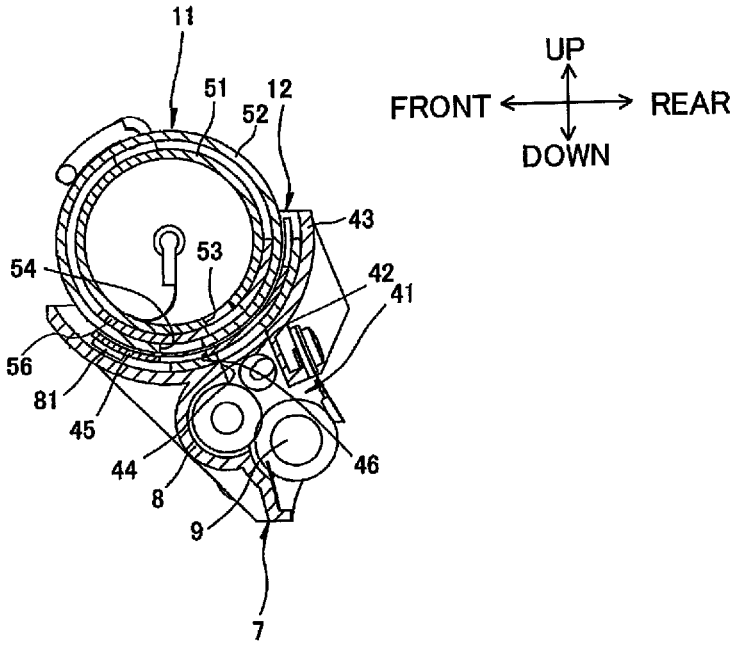
FIG. 5A is a cross-sectional right side view of a developing unit and the toner cartridge with an outer casing at a closing position.
Figure 5B:
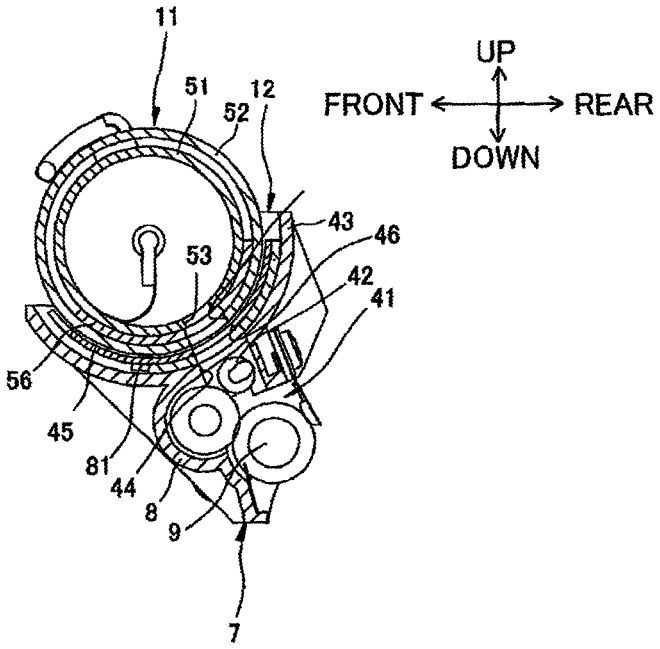
FIG. 5B is a cross-sectional view of the developing unit and the toner cartridge with the outer casing at an opening position.

Each developing frame 8 is formed with a developing chamber 41 that accommodates the developing roller 9. The developing chamber 41 is open at the side of the photosensitive drum 5, and the developing roller 9 is disposed at an end of the developing chamber 41 near this opening. As shown in FIGS. 5A and 5B, an auger 42 is disposed in the developing chamber 41. The auger 42 is for conveying toner in the developing chamber 41 from the center toward the right and left sides in the developing chamber 41.

Each developing frame 8 is provided with a plate-shaped partitioning wall 43 at a position between the developing chamber 41 and the space 12. The partitioning wall 43 protrudes in an arc shape toward the developing chamber 41, and partitions the interior of the developing frame 8 into the developing chamber 41 and the space 12 located higher than the developing chamber 41.

The partitioning wall 43 is formed with a rectangular opening 44 that fluidly communicates the developing chamber 41 and the space 12.

The developing frame 8 is also provided with a plate-shaped developing shutter 45 that is disposed on and slidable along the partitioning wall 43 in the front-rear direction. The developing shutter 45 extends in the right-left direction and is curved to follow the arc shape of the partitioning wall 43.

The developing shutter 45 is formed with a shutter opening 46 at the same position as the opening 44 with respect to the right-left direction. Thus, the developing shutter 45 can selectively open and close the opening 44 by sliding in the front-rear direction along the partitioning wall 43. That is, when the developing shutter 45 is at an opening position where the shutter opening 46 overlaps the opening 44 as shown in FIG. 5B, the opening 44 is open. When the developing shutter 45 is at a closing position where the shutter opening 46 confronts an inner surface of the partitioning wall 43 as shown in FIG. 5A, on the other hand, the opening 44 is closed.

As shown in FIGS. 5A and 5B, each toner cartridge 11 includes an inner casing 51 and an outer casing 52, both in a hollow cylindrical shape. The outer casing 52 (hollow cylindrical shutter) rotatably accommodates the inner casing 51.

The inner casing 51 is formed with an inner opening 53 in a peripheral wall thereof. The inner opening 53 is formed at a position opposite to the opening 44 of the partitioning wall 43 in a state that the toner cartridge 11 is accommodated in the space 12.

The outer casing 52 is formed with a plurality of outer openings 54 in a peripheral wall thereof. The outer openings 54 are aligned at intervals in the right-left direction and are located at positions opposite to the shutter opening 46 of the developing shutter 45 in a state that the toner cartridge 11 is accommodated in the space 12.

The outer casing 52 is also formed with a protrusion 55 shown in FIG. 3 on a right surface thereof. The protrusion 55 has a shorter dimension in the right-left direction than the guide groove 31, and can engage with and completely fit in the guide groove 31.

As shown in FIGS. 5A and 5B, a toner seal 56 is attached on an outer peripheral surface of the inner casing 51 to encircle the inner opening 53.

Figure 6:
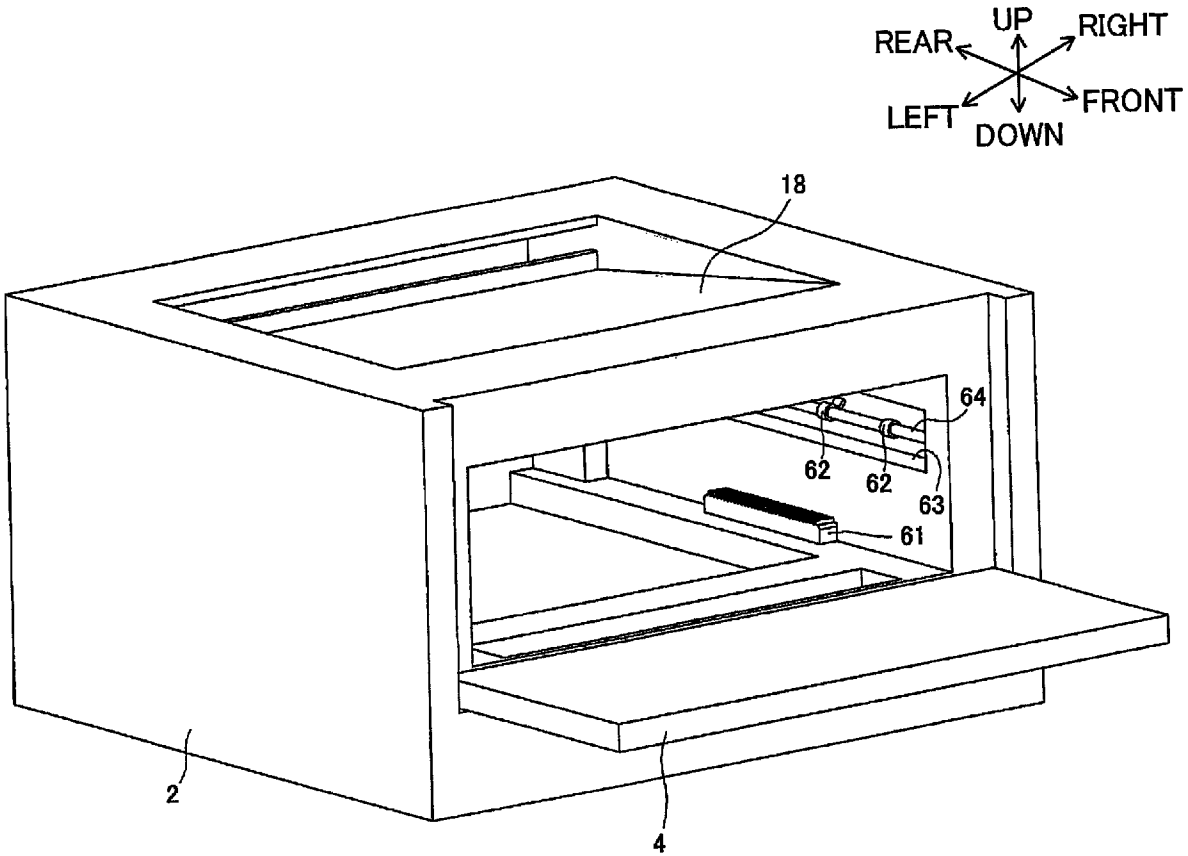
FIG. 6 is a perspective view of a main casing of the color laser printer, showing an internal structure of the main casing.
Figure 7:
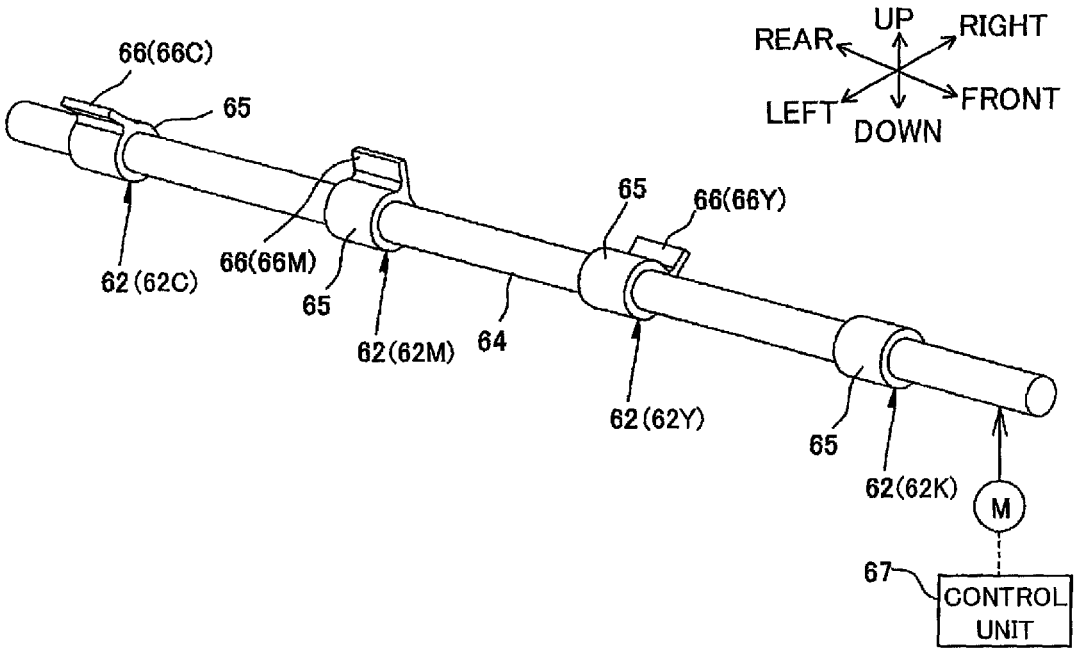
FIG. 7 is a perspective view showing presser bars and a shaft according to the first embodiment of the invention.

As shown in FIG. 6, the color laser printer 1 further includes a rack gear (driving force generating member) 61 and four presser bars 62 (see FIG. 7 also). The rack gear 61 is disposed in a right section of the main casing 2. The rack gear 61 extends in the front-rear direction and has gear teeth facing upward. The height position of the rack gear 61 is determined such that the rack gear 61 can meshingly engage with an input gear 71 (FIG. 9) of the drawer unit 3 in the middle of the movement of the drawer unit 3 between the accommodated position and the pulled-out position.

The presser bars 62 are aligned at fixed intervals in the front-rear direction in the right section of the main casing 2.

The main casing 2 is formed with a groove 63 in an inner right surface thereof. The groove 63 is elongated in the front-rear direction and opposite to the right side of the drawer unit 3 at the accommodated position. A shaft 64 is disposed in the groove 63 along the front-rear direction, and is rotatably supported to the main casing 2. As shown in FIG. 7, each presser bar 62 integrally includes a cylindrical part 65 and a lever 66 extending from a periphery of the cylindrical part 65 in a tangential direction of the cylindrical part 65. The shaft 64 is inserted through the cylindrical part 65 of each presser bar 62 such that the shaft 64 cannot rotate relative to the presser bars 62. In this manner, the shaft 64 supports the four presser bars 62 with fixed intervals.

Figure 8:
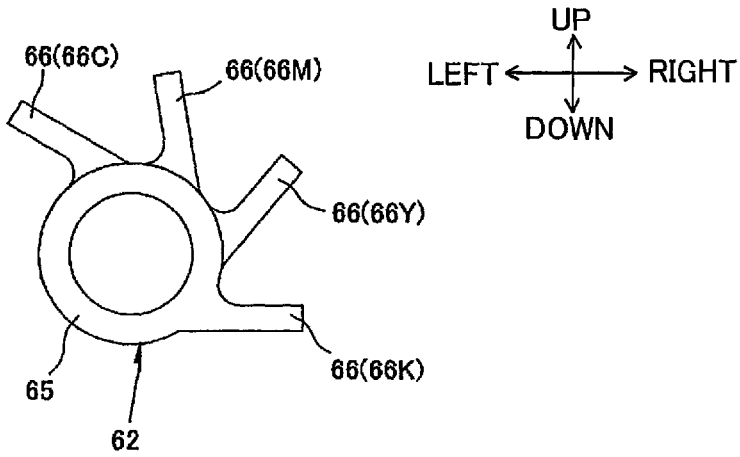
FIG. 8 is a front view of the presser bars of FIG. 7.

As shown in FIG. 8, the presser bars 62 are supported on the shaft 64 such that each lever 66 is deviated from a position of an adjacent lever 66 by a predetermined angle in the peripheral direction of the shaft 64. More specifically, as shown in FIGS. 7 and 8, the four presser bars 62 specifically include presser bars 62K, 62Y, 62M and 62C having respective levers 66K, 66Y, 66M, and 66C. When the lever 66K of the presser bar 62K extends rightward along the horizontal direction, the lever 66Y of the presser bar 62Y extends diagonally upward and rightward, and the lever 66M of the presser bar 62M extends upward, and the lever 66C of the presser bar 62C extends diagonally upward and leftward.

The shaft 64 is supplied with a drive force from a motor M disposed in the main casing 2, and a control unit 67 including a microcomputer controls the driving of the motor M.

As shown in FIG. 9, the input gear 71 is disposed on the outer surface (right surface) of the right side plate 23 of the drawer frame 21 at a position lower than and slightly frontward of the shutter driving member 26C. The input gear 71 is rotatably supported to the right side plate 23 via a shaft extending in the right-left direction, and a lower part of the input gear 71 projects downward beyond the lower edge of the right side plate 23.

The input gear 71 is in meshing engagement with the first relay gear 72 located diagonally upward and frontward thereof. The first relay gear 72 is rotatably supported to the right side plate 23 via a shaft extending in the right-left direction.

The second relay gear 73 and the third relay gear 74 (output gears) having the same diameter are disposed one on either side of the first relay gear 72 in the front-rear direction. The second relay gear 73 and the third relay gear 74 are disposed directly beneath the shutter driving member 26C and the shutter driving member 26M, respectively, in the up-down direction. The second relay gear 73 and the third relay gear 74 are rotatably supported to the right side plate 23 via respective shafts extending in the right-left direction, and are in meshing engagement with the first relay gear 72.

The third relay gear 74 is in meshing engagement with a fourth relay gear 75 having the same diameter as the first relay gear 72. The fourth relay gear 75 and the first relay gear 72 are located symmetrical to a vertical line passing through the center of the third relay gear 74. The fourth relay gear 75 is rotatably supported to the right side plate 23 via a shaft extending in the right-left direction.

The fourth relay gear 75 is in meshing engagement with the fifth relay gear (output gear) 76 having the same diameter with the third relay gear 74. The fifth relay gear 76 and the third relay gear 74 are located symmetrical to a vertical line passing through the center of the fourth relay gear 75. The fifth relay gear 76 is disposed directly beneath the shutter driving member 26Y in the up-down direction, and is rotatably supported to the right side plate 23 via a shaft extending in the right-left direction.

The fifth relay gear 76 is in meshing engagement with a sixth relay gear 77 having the same diameter as the fourth relay gear 75. The sixth relay gear 77 and the fourth relay gear 75 are located symmetrical to a vertical line passing through the center of the fifth relay gear 76. The sixth relay gear 77 is rotatably supported to the right side plate 23 via a shaft extending in the right-left direction.

The sixth relay gear 77 is in meshing engagement with the seventh relay gear (output gear) 78 having the same diameter as the fifth relay gear 76. The seventh relay gear 78 and the fifth relay gear 76 are located symmetrical to a vertical line passing through the center of the sixth relay gear 77. The seventh relay gear 78 is located directly beneath the shutter driving member 26K in the up-down direction, and is rotatably supported to the right side plate 23 via a shaft extending in the right-left direction.

The input gear 71, the first relay gear 72, the second relay gear 73, the third relay gear 74, the fourth relay gear 75, the fifth relay gear 76, the sixth relay gear 77, and the seventh relay gear 78 together function as a driving force transmitting mechanism TM.

Figure 10A:
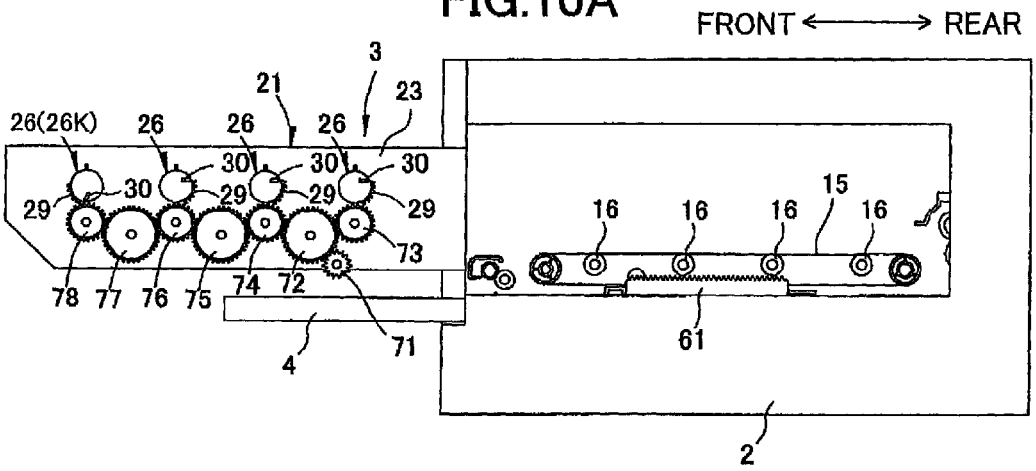
FIG. 10A is a cross-sectional right side view of the color laser printer with the drawer unit at a pulled-out position.

The toner cartridge 11 can be detached upward from the corresponding space 12 after the drawer unit 3 (the drawer frame 21) is pulled frontward to the pulled-out position outside the main casing 2 as shown in FIG. 10A.

In the drawer unit 3 shown in FIG. 10A, the toner cartridge 11Y is not accommodated in the space 12K as shown in FIG. 3. In this state, the shutter driving member 26K is in an orientation that the pressing member 30 slants diagonally frontward and downward at the lowest position and that the one end 29A (FIG. 4) of the gear part 29 is in meshing engagement with the seventh relay gear 78. That is, the shutter driving member 26K is at a second position. Also, as shown in FIG. 3, the guide groove 31 extends in the up-down direction, and the entrance port 33 of the right side plate 23 is aligned with the guide groove 31 in the up-down direction. Further, as shown in FIG. 5A, the developing shutter 45 is at the closing position, i.e., the shutter opening 46 is located frontward of the opening 44, and the opening 44 is closed by the developing shutter 45.

In the toner cartridge 11 detached from the drawer unit 3, as shown in FIG. 5A, the outer casing 52 is at a closing position. That is, the outer openings 54 of the outer casing 52 are located frontward of the inner opening 53 of the inner casing 51, so the inner opening 53 is closed by the outer casing 52. Also, the protrusion 55 (FIG. 3) formed on the right surface of the outer casing 52 extends in the up-down direction.

When the toner cartridge 11 is mounted into the space 12, the protrusion 55 of the toner cartridge 11 is held at an allowing position and guided into the guide groove 31 (FIG. 3) through the entrance port 33 formed in the right side plate 23. Because the entrance port 33 has the width that is substantially the same as that of the guide groove 31 at the bottom and that grows wider toward the top as described above, the entrance port 33 can smoothly receive and guide the protrusion 55 into the guide groove 31.

When the outer casing 52 comes into contact with the developing shutter 45 as shown in FIG. 5A, then the mounting of the toner cartridge 11 into the space 12 completes, and the protrusion 55 completely fits in the guide groove 31 as that of the toner cartridge 11Y shown in FIG. 3. Also, as shown in FIG. 5A, a shutter-driving boss 81 formed on the outer periphery of the outer casing 52 engages with an engagement hole (not shown) formed in the developing shutter 45, thereby linking the outer casing 52 with the developing shutter 45 such that outer casing 52 cannot rotate relative to the developing shutter 45.

Figure 10B:
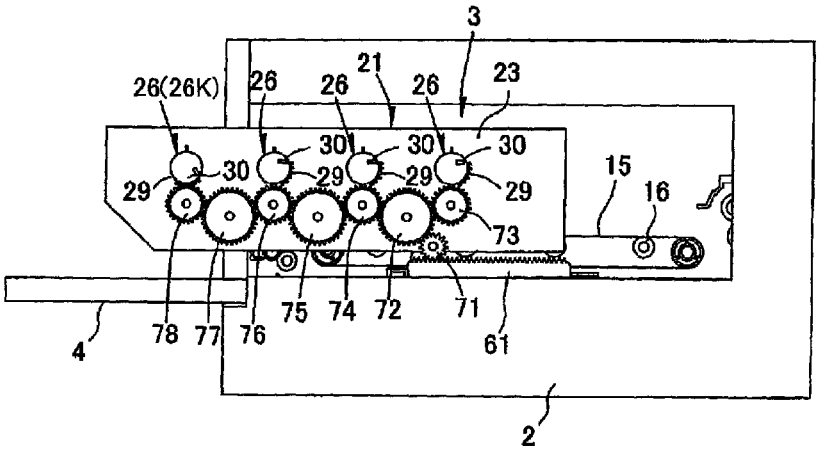
FIG. 10B is a cross-sectional right side view of the color laser printer with a drawer unit at a position between the pulled-out position and an accommodated position.

Then, the drawer unit 3 is moved rearward to the accommodated position in the main casing 2 (FIG. 2). In the middle of this rearward movement of the drawer unit 3, as shown in FIG. 10B, the input gear 71 supported to the drawer frame 21 comes into meshing engagement with the rack gear 61 disposed in the main casing 2. After this meshing engagement, the input gear 71 is rotated by the rack gear 61 as the drawer unit 3 moves rearward. The rotation of the input gear 71 is transmitted, as driving force, to the seventh relay gear 78 via the first relay gear 72, the third relay gear 74, the fourth relay gear 75, the fifth relay gear 76, and the sixth relay gear 77. As a result, the seventh relay gear 78 rotates in a clockwise direction in the right side view. Because the one end 29A (FIG. 4) of the gear part 29 of the shutter driving member 26K is in meshing engagement with the seventh relay gear 78 in the example shown in FIGS. 10A and 10B, the clockwise rotation of the seventh relay gear 78 rotates the shutter driving member 26K in a counterclockwise direction in a right side view.

The counterclockwise rotation of the shutter driving member 26K rotates the protrusion 55 (see FIG. 3) fitted in the guide groove 31 (see FIG. 4 also) in the counterclockwise direction in a right side view, so the outer casing 52 and the developing shutter 45 (FIG. 5A) rotate integrally with each other in the counterclockwise direction in a right side view. When the shutter driving member 26K rotates a predetermined stroke, the gear part 29 separates from the seventh relay gear 78 (i.e., the meshing engagement between the gear part 29 and the seventh relay gear 78 is released). As a result, the rotation of the shutter driving member 26K, the outer casing 52, and the developing shutter 45 is all stopped.

At this time, the outer casing 52 is located at an opening position with respect to the inner casing 51, and the developing shutter 45 is located at an opening position with respect to the partitioning wall 43. As a result, as shown in FIG. 5B, the shutter opening 46 of the developing shutter 45 and the outer openings 54 of the outer casing 52 respectively confront the opening 44 of the partitioning wall 43 and the inner opening 53 of the inner casing 51, so the interior of the inner casing 51 is fluidly connected to the developing chamber 41 via the inner opening 53, the outer openings 54, the shutter opening 46, and the opening 44.

Also, the protrusion 55 (FIG. 3) is at a restricting position where a longitudinal end of the protrusion 55 opposes an inner peripheral surface of the support hole 32. Thus, the inner peripheral surface of the support hole 32 functions as a stopper that prevents the toner cartridge 11 from being detached from the space 12.

Figure 10C:
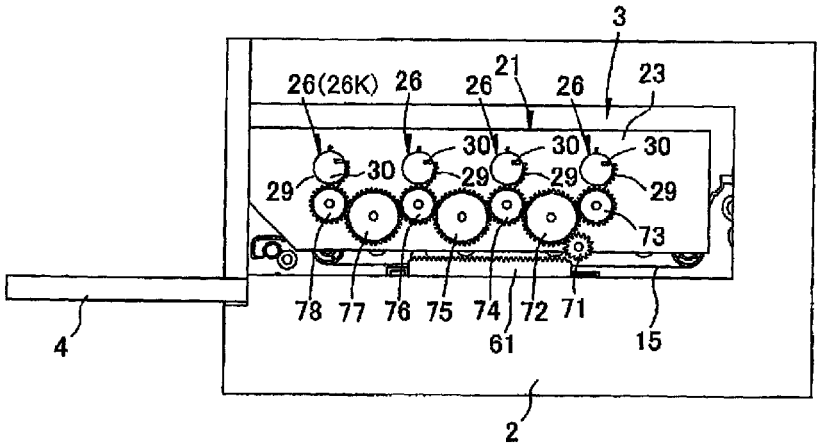
FIG. 10C is a cross-sectional right side view of the color laser printer with the drawer unit at the accommodated position.

When the drawer unit 3 reaches the accommodated position as shown in FIG. 10C, the meshing engagement between the rack gear 61 and the input gear 71 is released, and the input gear 71 is positioned rearward of the rack gear 61.

When remaining amount of toner in the inner casing 51 of the toner cartridge 11K becomes low after image forming operations are repeatedly performed (i.e., when a black toner empty condition is detected), for example, then the control unit 67 drives the motor M (FIG. 7) to rotate the shaft 64 a predetermined amount in the counterclockwise direction in a front view, which in turn rotates the four presser bars 62 in the counterclockwise direction in a front view.

Figure 11A:
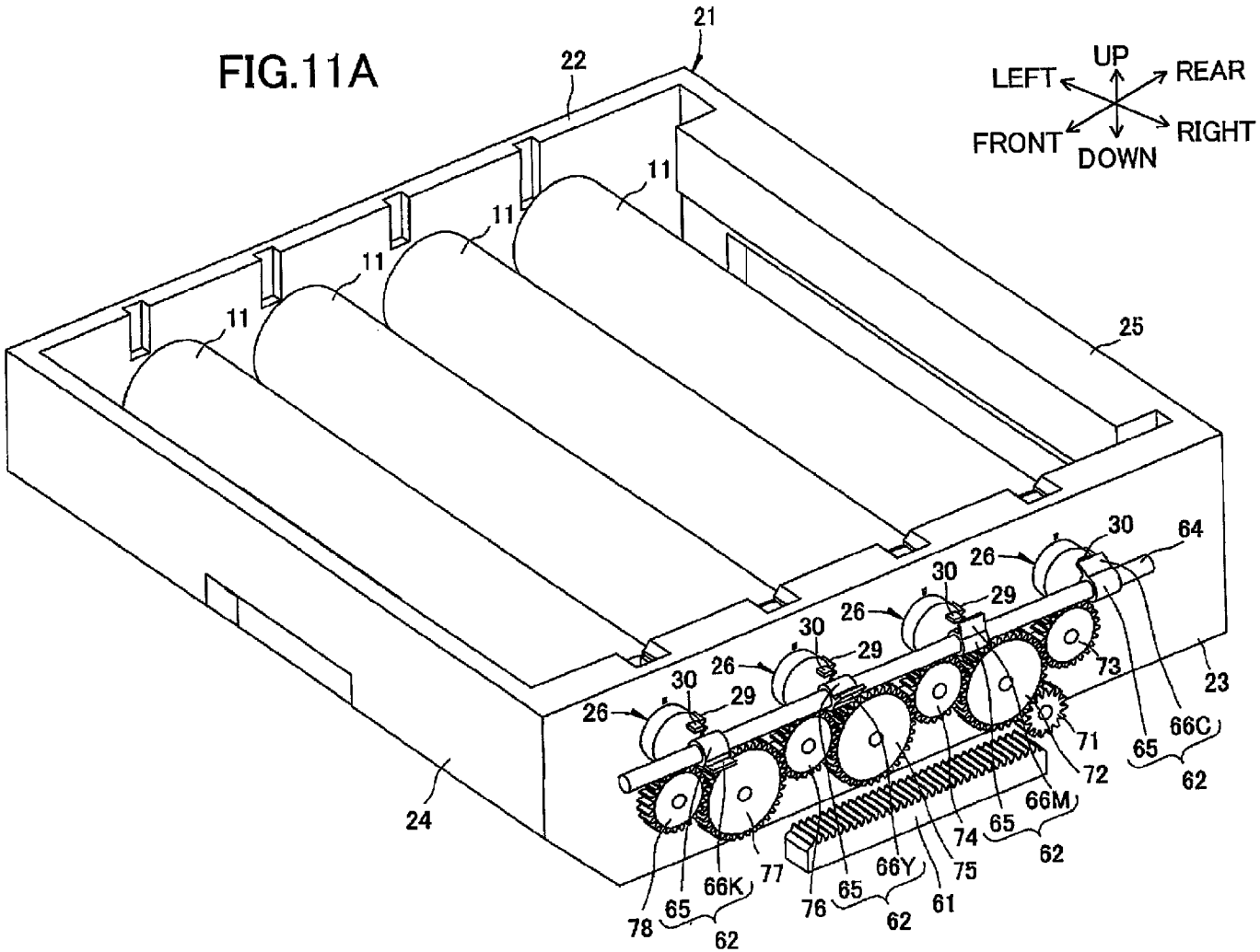
FIG. 11A is a perspective view of the drawer unit with the presser bars in a condition where none of the presser bars is pressing a pressing member.
Figure 11B:
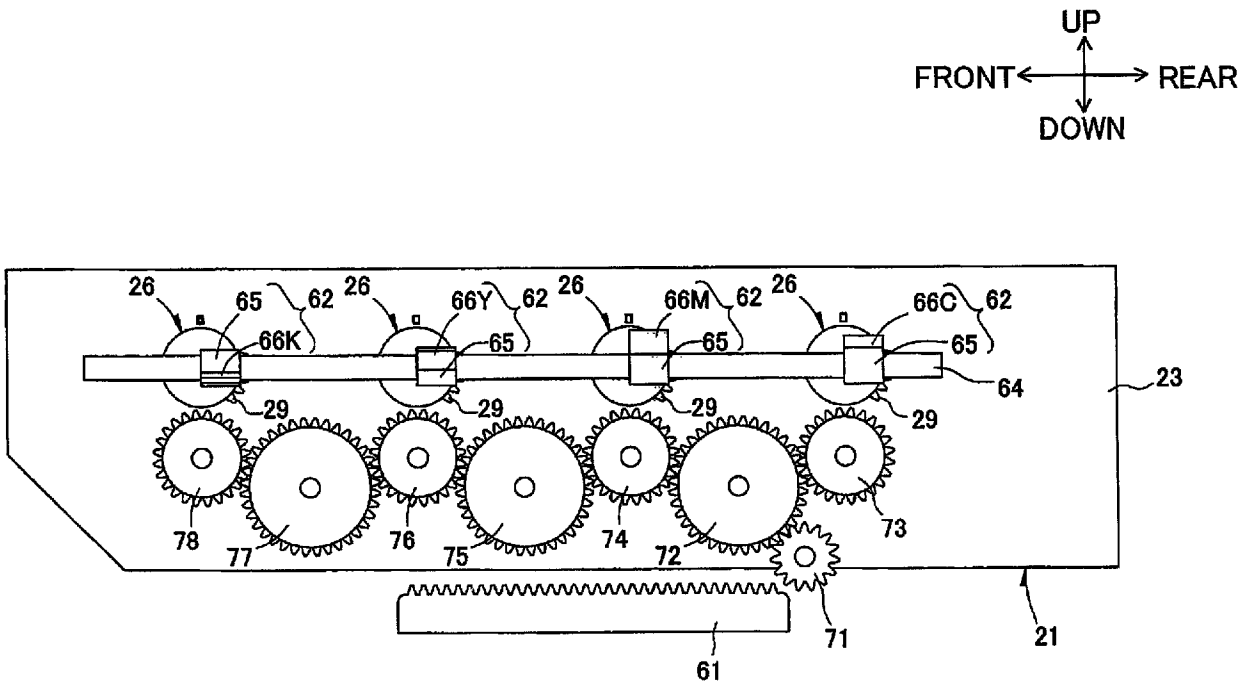
FIG. 11B is a right side view of the drawer unit with the presser bars in the condition shown in FIG. 11A.

Before the motor M starts driving, as shown in FIG. 11A, none of the presser bars 62 is in contact with the pressing member 30 of the corresponding toner cartridge 11. Also, as shown in FIG. 11B, the other end 29B (FIG. 9) of the gear part 29 of each shutter driving member 26 is separate rearward from corresponding one of the second relay gear 73, the third relay gear 74, the fifth relay gear 76, and the seventh relay gear 78, and is out of meshing engagement with the same.

Figure 12A:
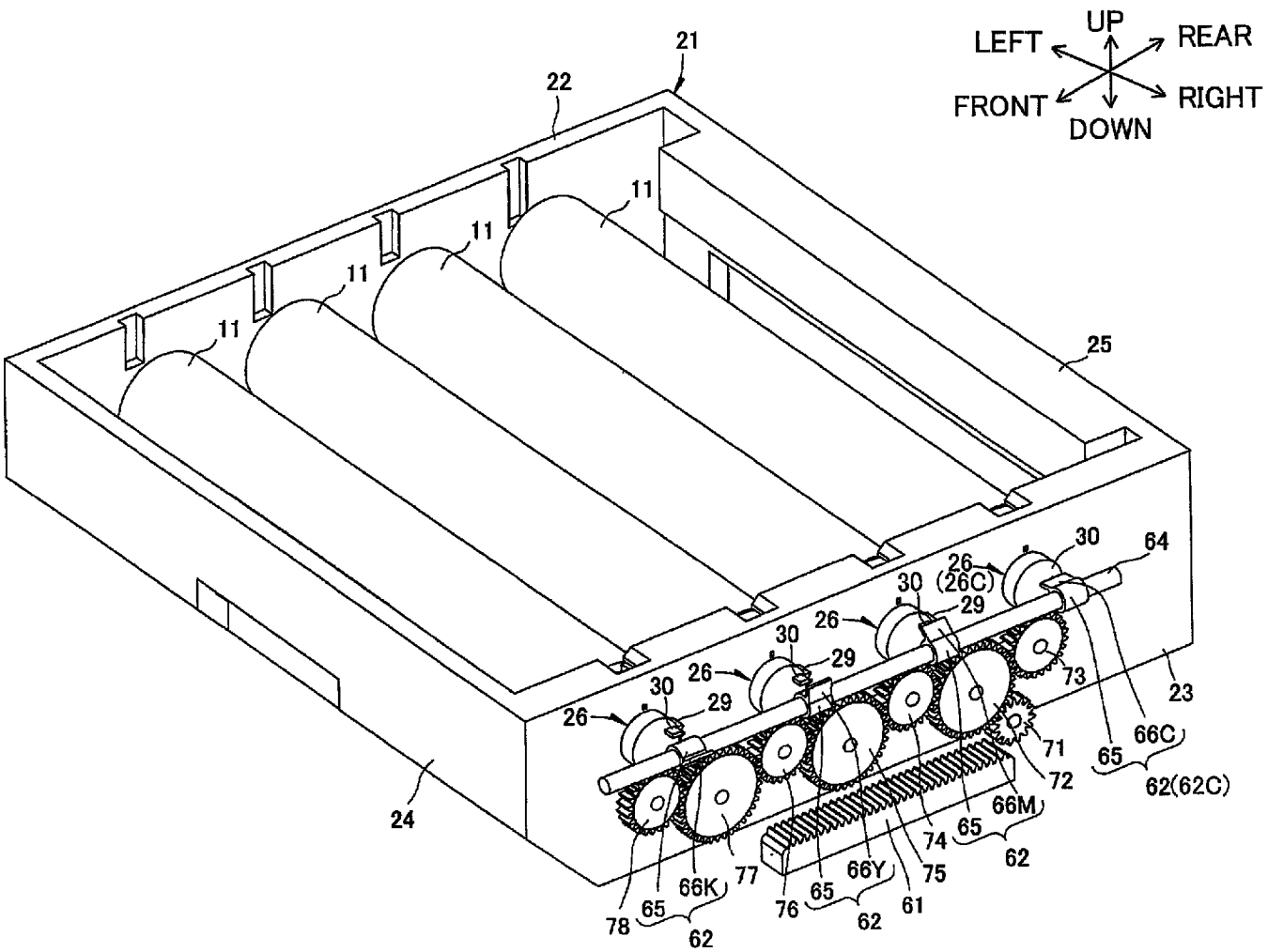
FIG. 12A a perspective view of the drawer unit with the shaft having been rotated from a condition shown in FIG. 11A.
Figure 12B:
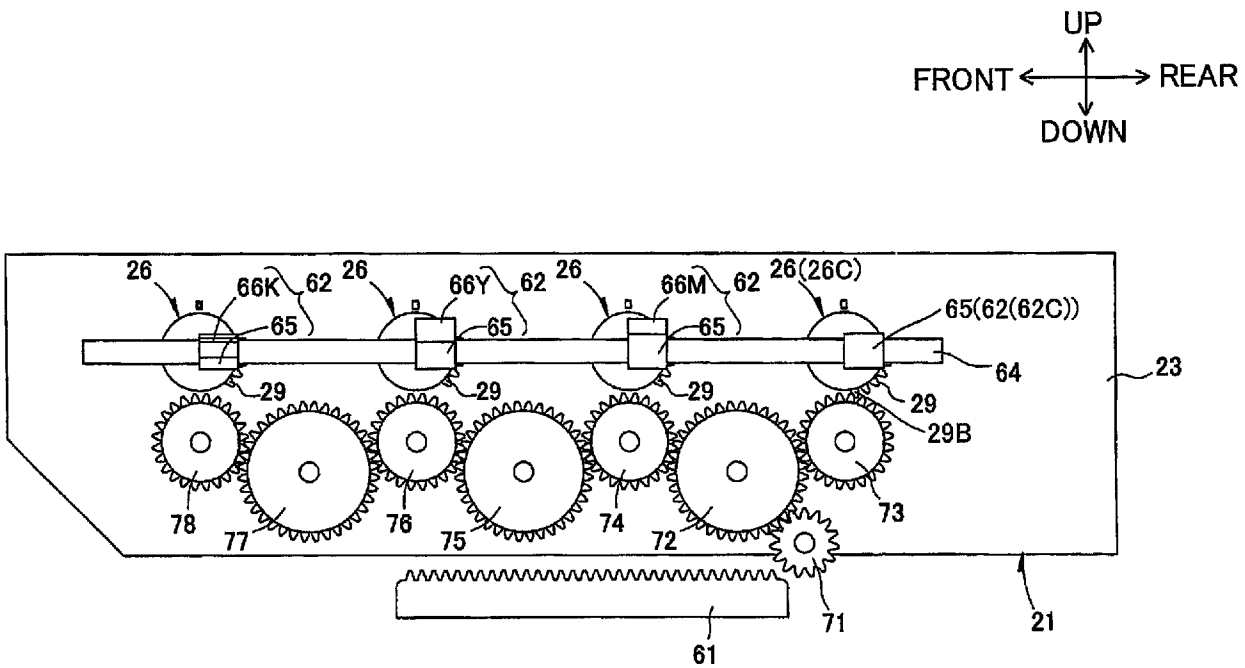
FIG. 12B is a right side view of the drawer unit with the shaft in the condition shown in FIG. 12A.

As the presser bars 62 rotate together with the shaft 64, each presser bar 62 comes into abutment with the pressing member 30 of the corresponding toner cartridge 11 at a different timing. As shown in FIGS. 12A and 12B, when the presser bar 62 abuts the pressing member 30, the presser bar 62 presses the pressing member 30 downward to rotate the shutter driving member 26 in the clockwise direction in a right side view against the urging force of the wire spring 34 (FIG. 4). When the presser bar 62 separates from the pressing member 30 thereafter, the clockwise rotation of the shutter driving member 26 is stopped, and the urging force of the wire spring 34 rotates the shutter driving member 26 in the counterclockwise direction in a right side view back to an original position where the shutter driving member 26 was located before rotated by the presser bar 62.

For example, when the pressing member 30 of the shutter driving member 26C is pressed downward by the presser bar 62C, then the shutter driving member 26C rotates in the clockwise direction in a right side view. As a result, as shown in FIG. 12B, the other end 29B of the gear part 29 meshingly engages with the second relay gear 73. When the presser bar 62C separates from the pressing member 30 thereafter, then the urging force of the wire spring 34 rotates the shutter driving member 26C in the counterclockwise direction in a right side view to release the meshing engagement between the gear part 29 and the second relay gear 73.

Figure 13A:
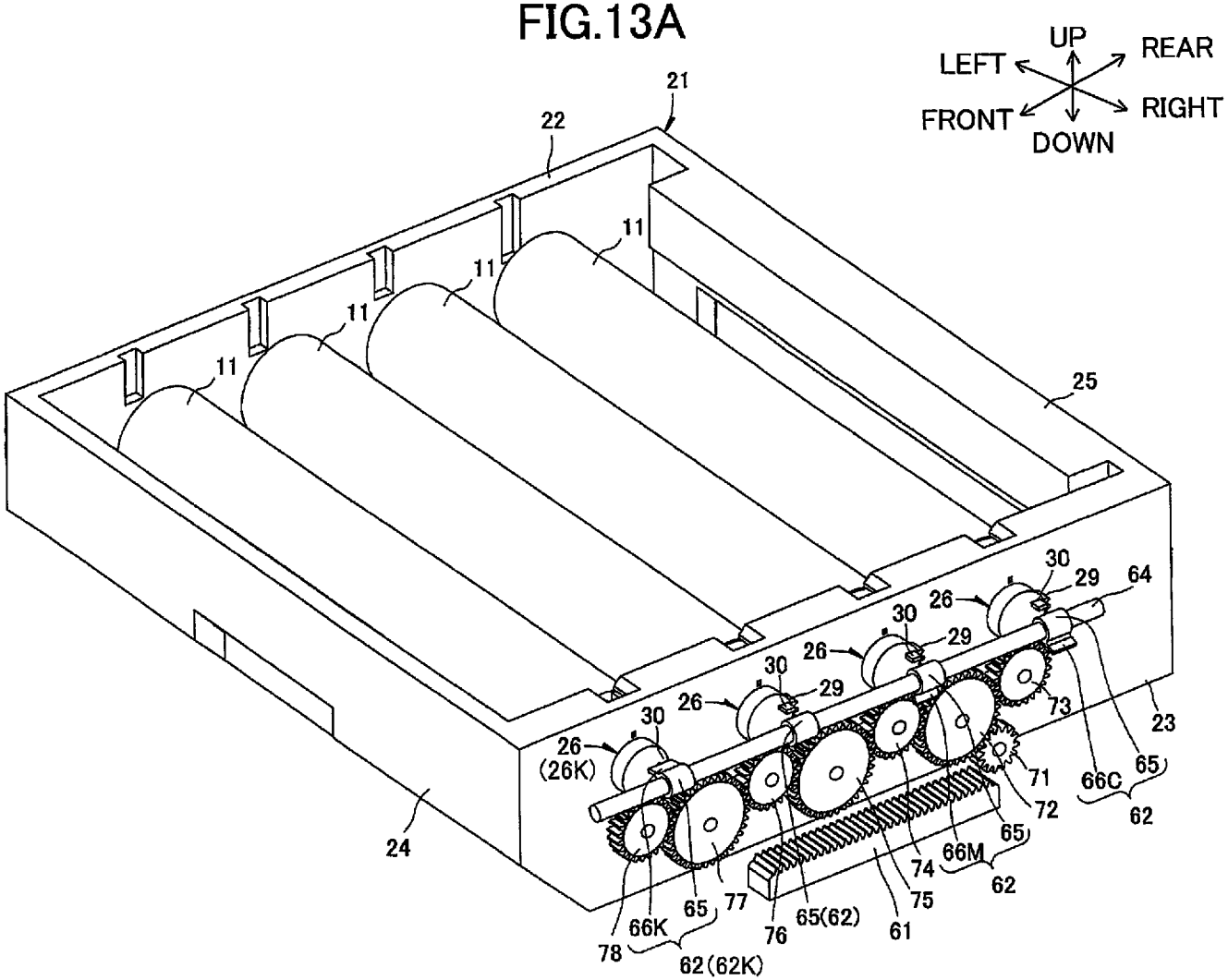
FIG. 13A is a right side view of the drawer unit with the first presser bar from the front pressing the pressing member.
Figure 13B:
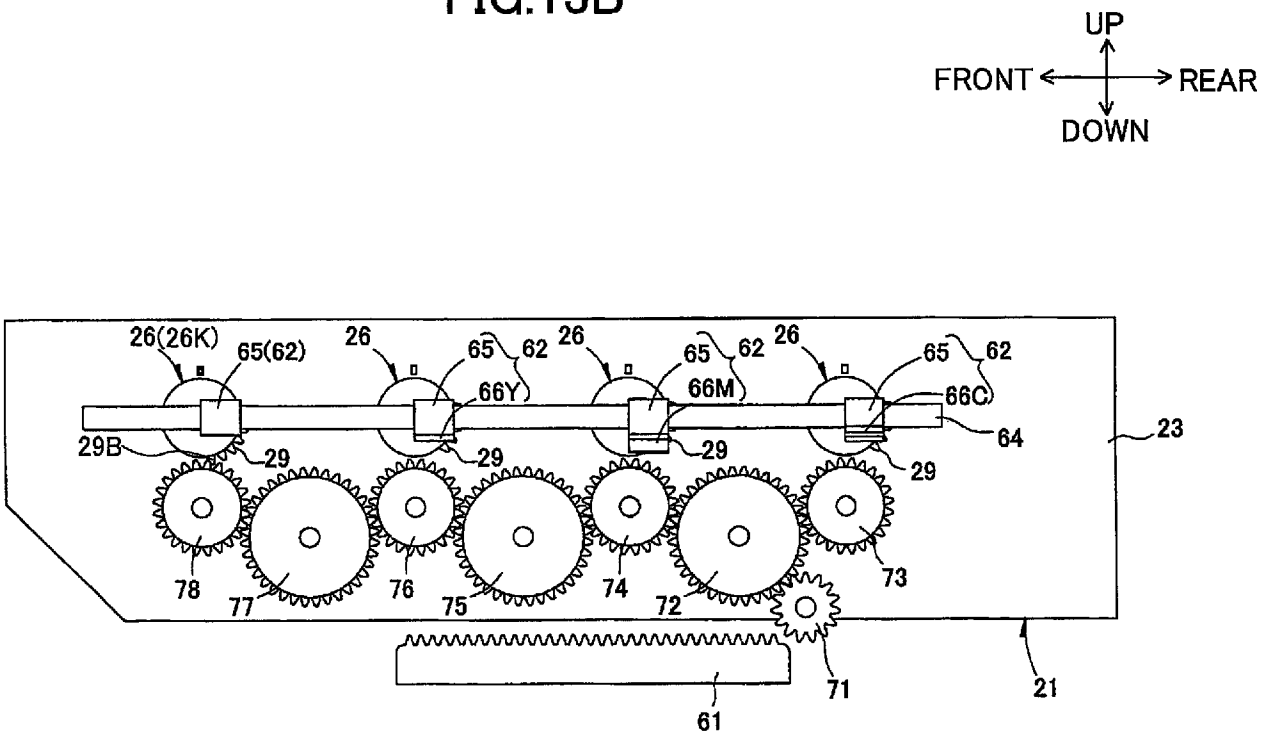
FIG. 13B is a right side view of the drawer unit with the first presser bar from the front in the condition shown in FIG. 13A.

When the shaft 64 has been rotated by the predetermined amount, the pressing member 30 of the shutter driving member 26K is pressed downward by the presser bar 62K as shown in FIG. 13A, and the control unit 67 stops driving the motor M. Thus, as shown in FIG. 13B, the other end 29B of the gear part 29 of the shutter driving member 26K is maintained in meshing engagement with the seventh relay gear 78. (The shutter driving member 26K is maintained at a first position).

When the drawer unit 3 is pulled frontward from the accommodated position toward the pulled-out position thereafter, the input gear 71 supported to the drawer frame 21 comes into meshing engagement with the rack gear 61 disposed in the main casing 2. After this meshing engagement, the input gear 71 is rotated by the rack gear 61 as the drawer unit 3 moves frontward. The rotation of the input gear 71 is transmitted, as driving force, to the seventh relay gear 78 via the first relay gear 72, the third relay gear 74, the fourth relay gear 75, the fifth relay gear 76, and the sixth relay gear 77. As a result, the seventh relay gear 78 rotates in the counterclockwise direction in a right side view. Because the other end 29B of the gear part 29 of the shutter driving member 26K is in meshing engagement with the seventh relay gear 78 (FIG. 13B), the counterclockwise rotation of the seventh relay gear 78 rotates the shutter driving member 26K in the clockwise direction in a right side view.

The clockwise rotation of the shutter driving member 26K rotates the protrusion 55 (FIG. 3) fitted in the guide groove 31 in the clockwise direction in a right side view, so the outer casing 52 of the toner cartridge 11K rotates together with the developing shutter 45 (FIG. 5B) in the clockwise direction in a right side view. When the shutter driving member 26K rotates a predetermined stroke, the gear part 29 separates from the seventh relay gear 78 (i.e., the meshing engagement between the gear part 29 and the seventh relay gear 78 is released). As a result, the rotation of the shutter driving member 26K, the outer casing 52, and the developing shutter 45 is all stopped.

At this time, the outer casing 52 is located at the closing position with respect to the inner casing 51, and the developing shutter 45 is located at the closing position with respect to the partitioning wall 43. Thus, as shown in FIG. 5A, the developing shutter 45 closes the opening 44, and the outer casing 52 closes the inner opening 53.

Thus, the outer casing 52 and the developing shutter 45 of only the toner cartridge 11K is brought into the respective closing positions while the outer casings 52 and the developing shutters 45 of the other toner cartridges 11 are maintained at the respective opening positions.

Note that when any of the remaining toner cartridges 11Y, 11M, 11C runs out of toner, then the corresponding outer casing 52 and the corresponding developing shutter 45 are brought to the respective closing positions in the same manner.

As described above, according to the above-described first embodiment, the drawer frame 21 is movable between the accommodated position in the main casing 2 and the pulled-out position outside the main casing 2. The drawer frame 21 supports the plurality of photosensitive drums 5 aligned at fixed intervals in the moving direction of the drawer frame 21. The drawer frame 21 also supports the plurality of developing units 7 corresponding to the photosensitive drums 5. The toner cartridges 11 are detachably mounted on the drawer frame 21 and in correspondence with the developing units 7.

The toner cartridge 11 includes the inner casing 51 for accommodating toner. The inner casing 51 is formed with the inner opening 53 through which toner is supplied to the developing unit 7. The toner cartridge 11 also includes the outer casing 52 that is movable between the opening position for opening the inner opening 53 and the closing position for closing the inner opening 53. The outer casing 52 is rotated by the shutter driving member 26.

The rack gear 61 is disposed in the main casing 2, and the driving force transmission mechanism TM is disposed on the drawer frame 21 for transmitting the driving force generated by the rack gear 61 to the shutter driving member 26. The driving force generated by the rack gear 61 is transmitted by the driving force transmission mechanism TM to the shutter driving member 26, which rotates the outer casing 52 upon reception of the driving force. Thus, it is unnecessary for a user to manually open and close the outer casing 52 when attaching or detaching the toner cartridge 11 to or from the drawer frame 21.

This reduces burden on the user when attaching or detaching the toner cartridge 11 to or from the drawer frame 21.

Also, the control unit 67, the motor M, the shaft 64, and the presser bars 62 function as a shutter closing mechanism for moving the outer casing 52 of the toner cartridge 11 to be replaced from the opening position to the closing position while maintaining the outer casings 52 of the other toner cartridges 11 at the opening positions. Thus, it is unnecessary for the user to manually rotate the outer casing 52 when detaching the toner cartridge 11 from the drawer frame 21 to replace the same. This reduces burden on the user when attaching or detaching the toner cartridge 11 to or from the drawer frame 21.

Because only one of the outer casings 52 of the toner cartridge 11 to be replaced is moved to the closing position while the remaining outer casings 52 are maintained at the opening positions, the rotation number of the outer casing 52 can be reduced. This suppresses degradation of the toner seals 56 disposed to encircle the inner openings 53. This makes it possible to use the toner seals 56 made of less-expensive materials with lower durability, thereby reducing overall production costs of the color laser printer 1.

Because it is unnecessary for a user to perform an operation to close the outer casing 52 while the drawer frame 21 is at the pulled-out position, no moment is generated in the main casing 2 by this operation. Thus, the color laser printer 1 is prevented from overturned by such moment.

The drawer frame 21 includes the side plates 22 and 23 facing each other with the photosensitive drums 5 and the developing units 7 interposed therebetween. The shutter driving members 26 are provided to penetrate through the right side plate 23, and the driving force transmitting mechanism TM are disposed outside of the right side plate 23. The driving force transmitting mechanism TM can receive the driving force from the rack gear 61 on the outside of the right side plate 23, and the shutter driving member 26 can transmit the driving force from the outside to the inside of the right side plate 23.

The driving force transmitting mechanism TM is a gear train including the input gear 71, the second relay gear 73, the third relay gear 74, the fifth relay gear 76, and the seventh relay gear 78. Thus, the driving force transmitting mechanism TM can reliably transmit the driving force from the rack gear 61 to the shutter driving member 26, thereby reliably rotating the outer casing 52.

Because the input gear 71 meshingly engages with the rack gear 61, the input gear 71 is rotated by the rack gear 61 when the drawer frame 21 moves between the accommodated position and the pulled-out position. The rotation of the input gear 71 is transmitted as the driving force to the shutter driving member 26, which in turn rotates the outer casing 52. Thus, a motor for rotating the outer casing 52 is unnecessary, and this makes the configuration of the color laser printer 1 simple and reduces production costs of the color laser printer 1.

The second relay gear 73, the third relay gear 74, the fifth relay gear 76, and the seventh relay gear 78 are provided for the respective shutter driving members 26, but the color laser printer 1 only includes single input gear 71. Thus, the input gear 71 can reliably engage with the rack gear 61 although the driving force transmitting mechanism TM has relatively simple configuration. .

The shutter driving member 26 is movable between the first position (the position of the shutter driving member 26K in FIG. 10C) and the second position (the position of the shutter driving member 26K shown in FIG. 10A). When the outer casing 52 is at the opening position, the shutter driving member 26 is located at the first position. When the outer casing 52 is at the closing position, the shutter driving member 26 is at the second position.

The shutter driving member 26 is provided rotatable relative to the drawer frame 21 and includes the gear part 29 that engages with corresponding one of the second relay gear 73, the third relay gear 74, the fifth relay gear 76, and the seventh relay gear 78 in a predetermined rotation angle range. By selectively engaging and disengaging between the gear part 29 and the corresponding gear 73, 74, 76, 77, the driving force transmission to the shutter driving member 26 is selectively realized and halted. Thus, it is possible to selectively rotate the outer casings 52 of the four toner cartridges 11.

The shutter driving member 26 is formed with the guide groove 31 extending straight, and the toner cartridge 11 is formed with the protrusion 55 that fits in the guide groove 31. When the toner cartridge 11 is attached to or detached from the drawer frame 21, the protrusion 55 moves along the guide groove 31 to guide the attachment or detachment of the toner cartridge 11 to or from the drawer frame 21. Thus, the toner cartridge 11 can be easily and smoothly attached to and detached from the drawer frame 21.

Because the protrusion 55 protrudes from the toner cartridge 11, the toner cartridge 11 is prevented from rotating about the protrusion 55. Thus, the toner cartridge 11 can be easily and smoothly attached to and detached from the drawer frame 21 even further.

The protrusion 55 is located at the restricting position when the outer casing 52 is at the opening position and is located at the allowing position when the outer casing 52 is at the closing position. When the protrusion 55 is at the restricting position, the longitudinal end of the protrusion 55 confronts the inner peripheral surface of the support hole 32, whereby the protrusion 55 cannot be detached from the guide groove 31. This configuration reliably prevents the toner cartridge 11 from being detached from the drawer frame 21 when the outer casing 52 is at the opening position.

<Second Embodiment>

Next, a color laser printer 101 according to a second embodiment of the invention will be described with reference to FIGS. 14 to 23B. Note that an external configuration and a configuration seen in a center cross-sectional side view of the color laser printer 101 are identical to those of the color laser printer 1 of the above-described first embodiment. That is, these configurations of the color laser printer 101 are identical to those shown in FIGS. 1 and 2.

It is to be noted that like parts or like portions as those in the first embodiment are designated by like reference numerals, and duplicate description is omitted with respect to the arrangement same as that described with reference to the first embodiment.

Figure 14:
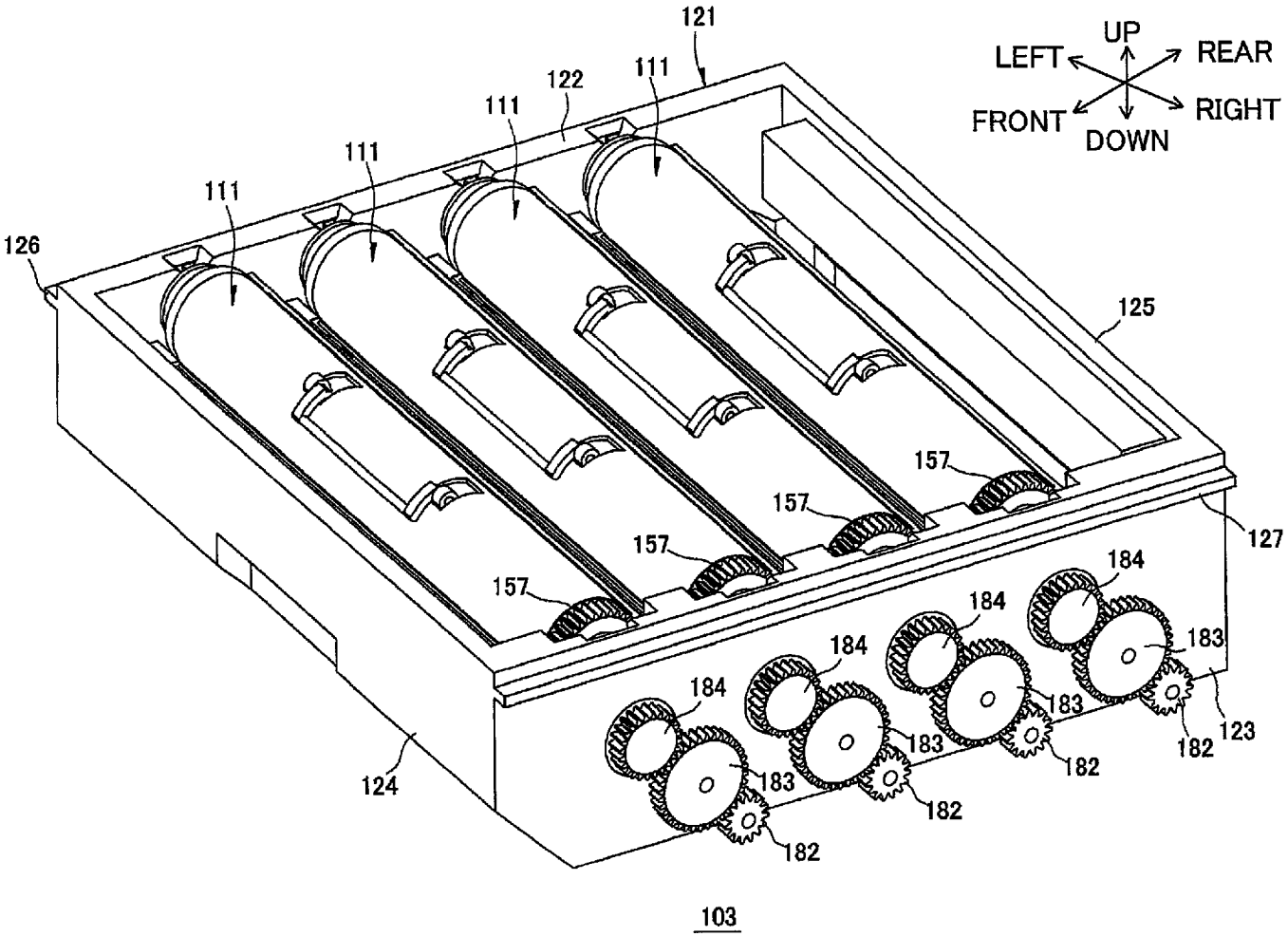
FIG. 14 is a perspective view of a drawer unit of a color laser printer according to a second embodiment of the invention, with toner cartridges mounted on the drawer unit.
Figure 20:
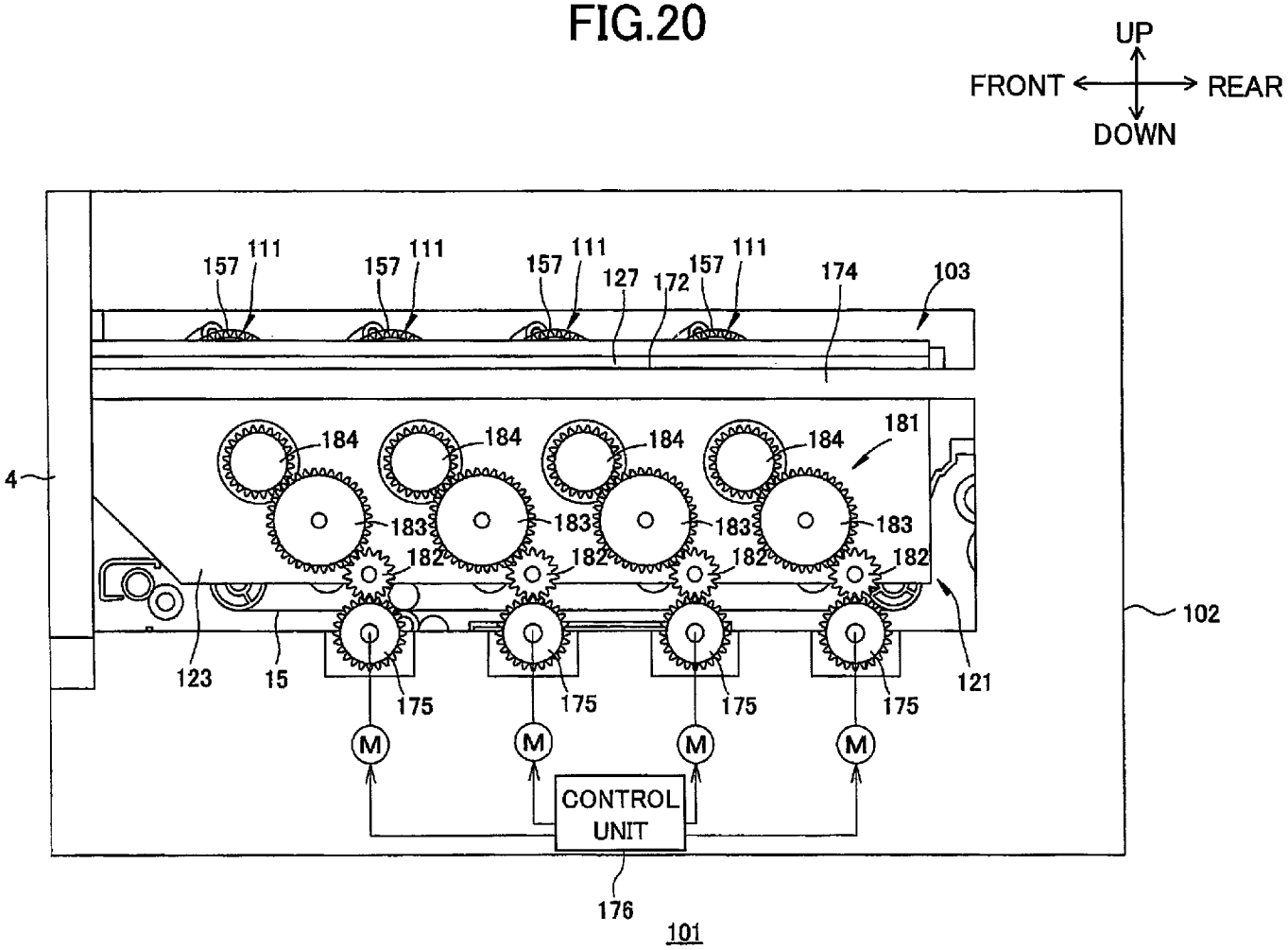
FIG. 20 is an explanatory cross-sectional side view of the color laser printer according to the second embodiment of the invention.

As shown in FIG. 20, the color laser printer 101 includes a drawer unit 103 having a drawer frame 121. As shown in FIG. 14, the drawer frame 121 includes a pair of left and right side plates 122 and 123 facing each other with a gap therebetween in the right-left direction, a front beam 124 spanning between front ends of the side plates 122 and 123, and a rear beam 125 spanning between rear ends of the side plates 122 and 123, and is formed in a rectangular frame shape as a whole in a plan view.

Figure 15:
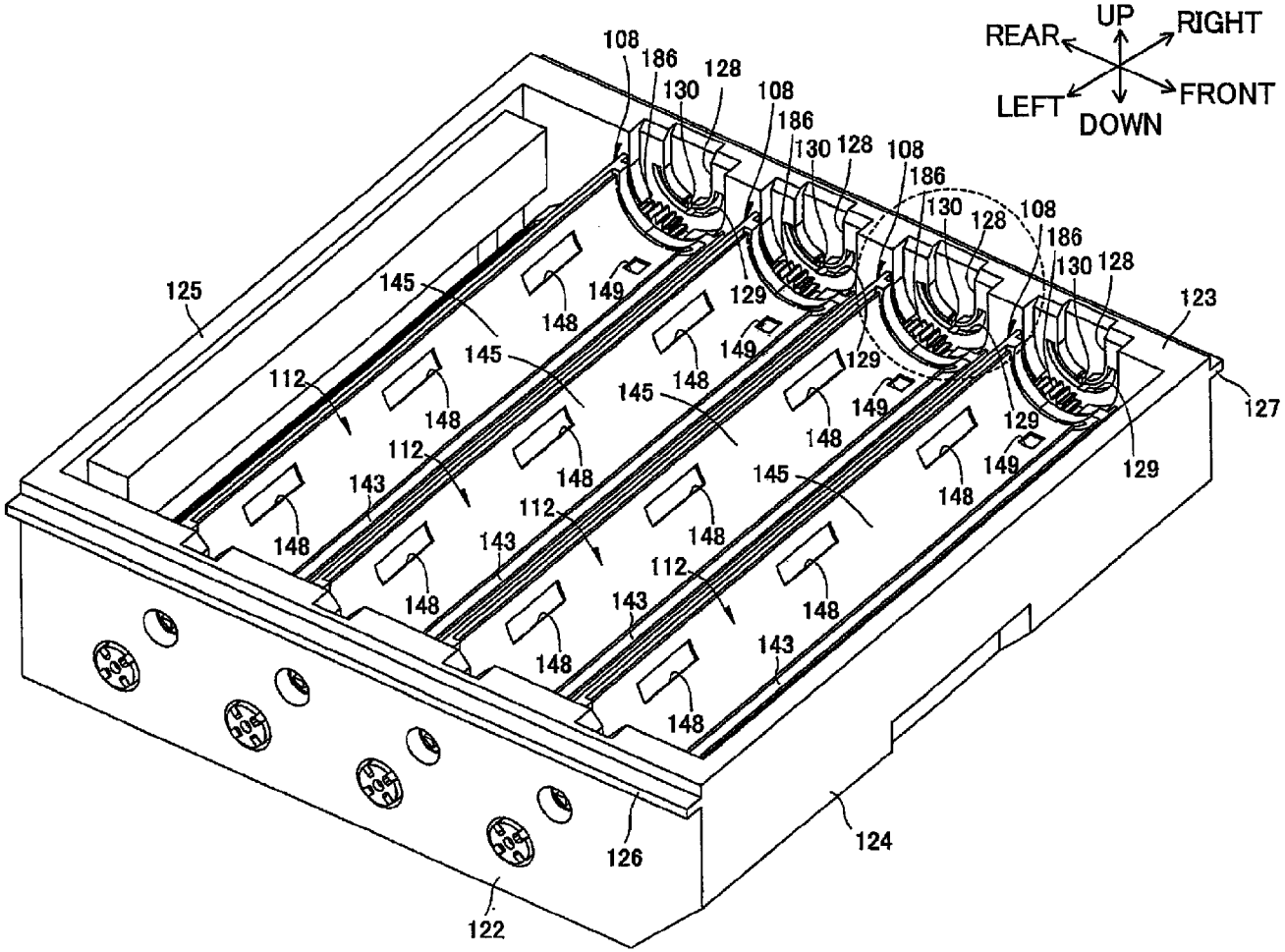
FIG. 15 is a perspective view of the drawer unit of FIG. 14 with the toner cartridges removed.

As shown in FIG. 15, the side plates 122 and 123 are facing each other in the right-left direction with spaces 112 defined therebetween. The spaces 112 are for accommodating respective toner cartridges 111 (FIG. 14).

The side plate 122, 123 is formed with a flange 126, 127 on an outer surface thereof at a position slightly lower than an upper edge thereof. The flange 126, 127 projects outward in the right-left direction and extends along the entire length of the side plate 122, 123 in the front-rear direction.

The right side plate 123 is formed with four support sections 128 in an inner side surface (left side surface) thereof. The support sections 128 are for receiving and supports support members 159 (FIG. 17) of the toner cartridges 111 to be described later, and are cutouts formed at a corner between an upper surface and the inner side surface of the right side plate 123. Each support section 128 is formed in a shape of letter U in a side view, has a width in the front-rear direction that is substantially the same as the outer diameter of the support member 159, and has a lower edge that curves at substantially the same curvature as an outer peripheral surface of the support member 159.

The right side plate 123 is also formed with four stopper grooves 129 in the inner side surface thereof at positions below and off the respective support sections 128. The stopper grooves 129 are for engaging with stopper bosses 158 (FIG. 18) of the toner cartridges 111 to be described later. Each stopper groove 129 is curved in an arc shape that is convex on the bottom so as to follow an arc-shaped lower edge of the support section 128.

Figure 16:
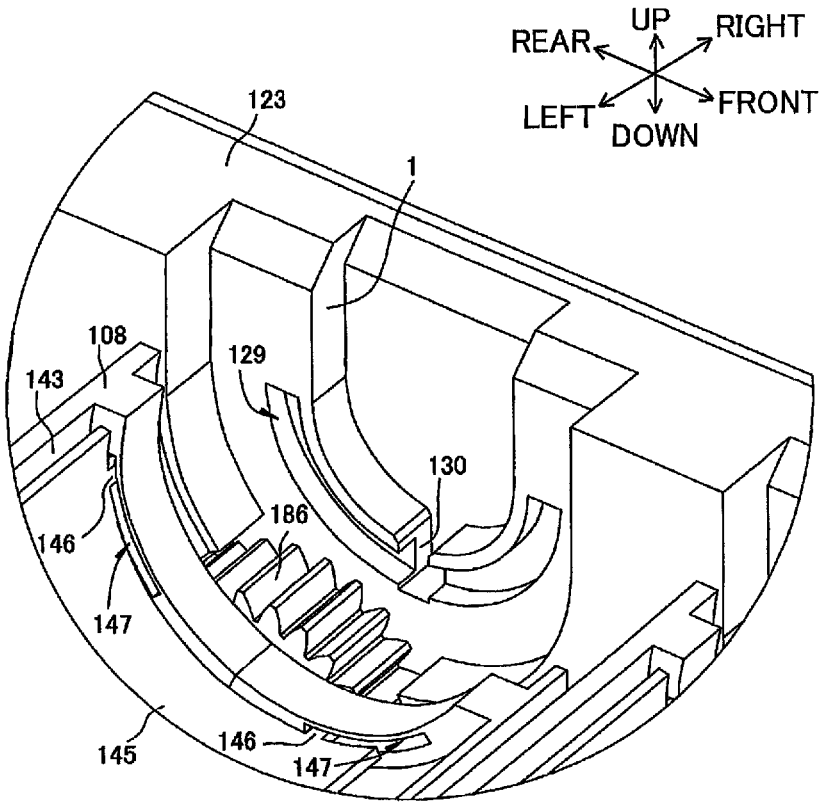
FIG. 16 is an enlarged perspective view of a part of FIG. 15 encircled by a dotted line.

As shown in FIG. 16, each support section 128 is fluidly connected to the corresponding stopper groove 129 through a communication port 130 formed between the bottom of the support section 128 and the stopper groove 129. The communication port 130 has a sufficient width in the front-rear direction that the stopper boss 158 (FIG. 18) of the toner cartridge 111 can pass therethrough.

Figure 22A:
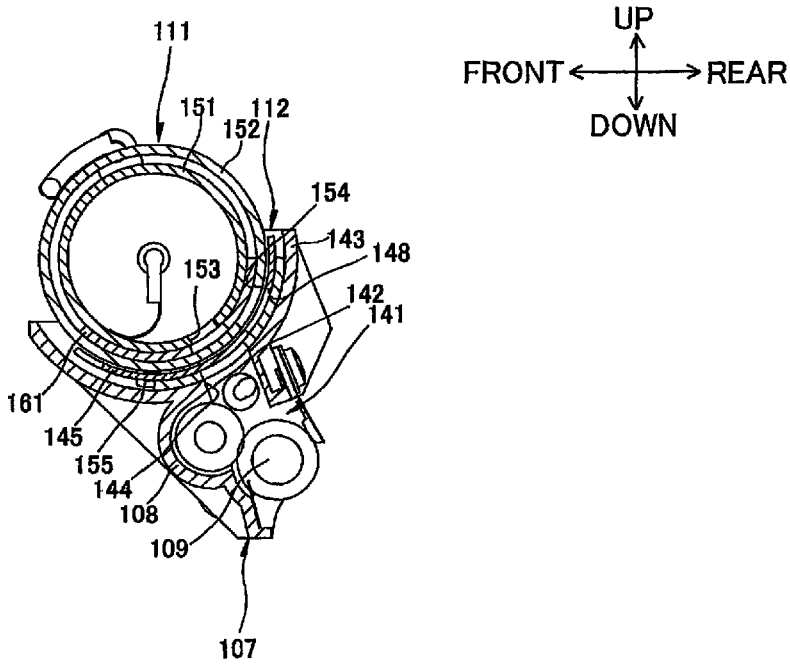
FIG. 22A is a cross-sectional right side view of a developing unit and the toner cartridge with an outer casing at a closing position according to the second embodiment of the invention.

The color laser printer 101 includes four developing units 107 shown in FIG. 22A (only one of which is shown). Each developing unit 107 includes a developing frame 108 defining a developing chamber 141 and a developing roller 109 accommodated in the developing chamber 141.

As shown in FIG. 15, the developing frames 108 of the developing units 107 are aligned in a line at fixed intervals in the front-rear direction and spanning between the side plates 122 and 123. The spaces 112 are partitioned by the developing frames 108.

As shown in FIG. 22A, the developing chamber 141 is open at the bottom, and the developing roller 109 is disposed at this open bottom section of the developing chamber 141. The developing unit 107 also includes an auger 142 disposed in the developing chamber 141 for conveying toner in the developing chamber 141 from the center to the right and left sides in the developing chamber 141.

Each developing frame 108 has a partitioning wall 143 between the space 112 and the developing chamber 141. The partitioning wall 143 is a plate-shaped member curved in an arc shape protruding toward the developing chamber 141, and partitions the interior of the developing frame 108 into the developing chamber 141 and the space 112 above the developing chamber 141.

The partitioning wall 143 is formed with three rectangular openings 144 at positions separate from each other in the right-left direction. The developing chamber 141 can fluidly communicate with the space 112 through the openings 144.

There is provided a developing shutter 145 on each partitioning wall 143. The developing shutter 145 extends in the right-left direction as shown in FIG. 15, and formed in a plate-like shape that curves along the partitioning wall 143 as shown in FIG. 22A. As shown in FIG. 16, the developing shutter 145 is formed with a pair of protrusions 146 that protrude rightward from a right edge thereof. The protrusions 146 are located at positions separate from each other in the front-rear direction. Although not shown in the drawings, the developing shutter 145 is also formed with another pair of protrusions 146 that protrude leftward from a left edge thereof. These protrusions 146 also are located at positions separate from each other in the front-rear direction.

The pairs of protrusions 146 are received in respective grooves 147 formed in the partitioning wall 143 so as to be movable along the grooves 147. With this configuration, the developing shutter 145 is mounted on the partitioning wall 143 so as to be slidable in the front-rear direction along the partitioning wall 143.

As shown in FIG. 15, the developing shutter 145 is formed with three rectangular shutter openings 148 at intervals in the right-left direction. The developing shutter 145 is also formed with substantially-square-shaped engaging holes 149, one at either right or left side thereof, at an interval in the right-left direction.

Figure 22B:
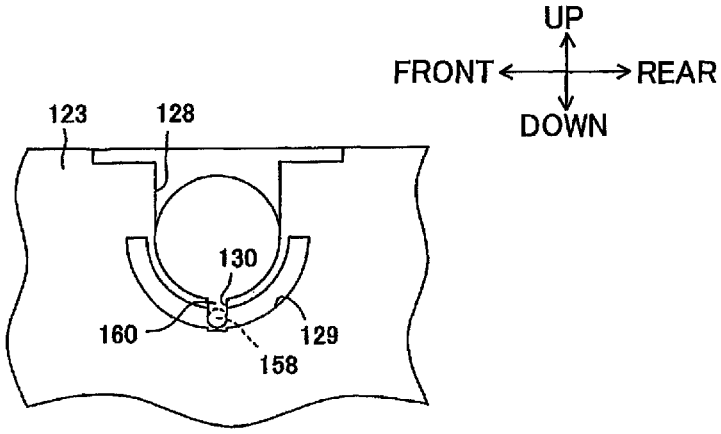
FIG. 22B is an explanatory side view showing a position of a stopper boss with respect to a stopper groove when an inner opening is closed.

As shown in FIGS. 22A and 22B, the toner cartridge 111 includes an inner casing (hollow cylindrical casing) 151 and an outer casing (hollow cylindrical shutter) 152 that rotatably accommodates the inner casing 151 therein.

The inner casing 151 is formed with an inner opening 153 in a periphery thereof at a position opposite to the openings 144 in a state where the toner cartridge 111 is accommodated in the space 112.

Figure 17:
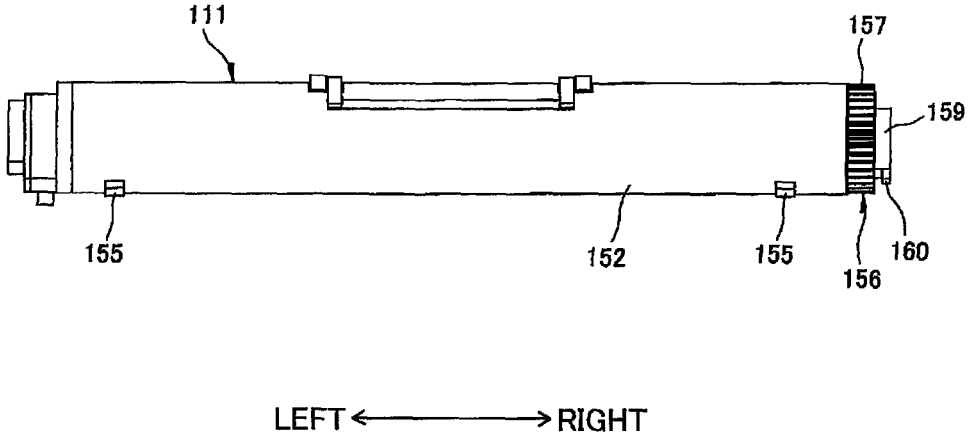
FIG. 17 is a front view of the toner cartridge shown in FIG. 13.

The inner casing 151 is also formed with the support member 159 shown in FIG. 17 on a right surface thereof. The support member 159 is column shaped and formed coaxial with the inner casing 151. The support member 159 protrudes rightward through and beyond a right side plate 156 (described next) of the outer casing 152 and is rotatable relative to the right side plate 156. The support member 159 is integrally formed with a protrusion 160 at a section rightward of the right side plate 156.

The outer casing 152 has a peripheral wall formed with a plurality of outer openings 154 shown in FIG. 22A (only one of which is shown) at intervals in the right-left direction. The outer openings 154 are formed at positions opposite to the shutter openings 148 in a condition where the toner cartridge 111 is accommodated in the space 112.

As shown in FIG. 17, the outer casing 152 is formed with a pair of shutter-driving bosses 155, one at either right or left section of the peripheral wall thereof. The shutter-driving bosses 155 are separate from each other the same distance as the engaging holes 149 (FIG. 15) formed in the developing shutter 145.

Figure 18:
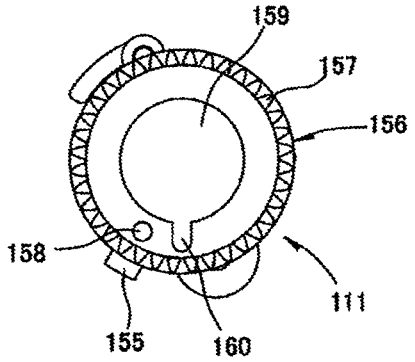
FIG. 18 is a right side view of the toner cartridge of FIG. 17.

The right side plate (disk-shaped shutter driving member) 156 is disposed at the right side end of the outer casing 152. The right side plate 156 is formed with gear teeth 157 on the entire peripheral surface thereof. As shown in FIG. 18, the stopper boss 158 shaped like a column is formed on the right side surface of the right side plate 156 at a position between a peripheral edge of the support member 159 and a peripheral edge of the right side plate 156.

As shown in FIG. 22A, a toner seal 161 is attached on the inner casing 151 to encircle the inner opening 153.

Figure 19:
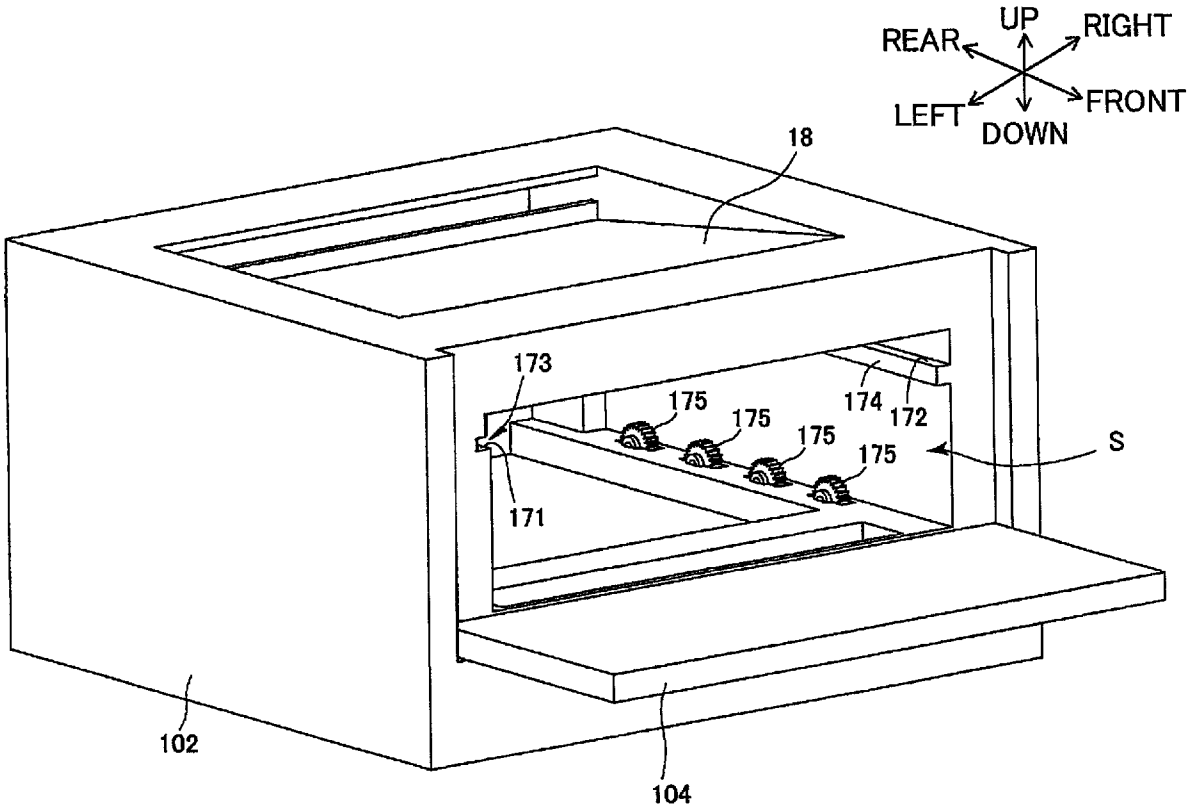
FIG. 19 is a perspective view of a main casing of the color laser printer of FIG. 14, showing an internal structure of the main casing.

As shown in FIG. 19, a main casing 102 is formed with guides 171 and 172 respectively on inner left and right surfaces thereof. More specifically, the inner left surface of the main casing 102 (an inner surface leftward of a space S for accommodating the drawer unit 103) is formed with a groove 173 extending in the front-rear direction, and a bottom surface of the groove 173 serves as the guide 171 for supporting the flange 126 (FIG. 15) of the left side plate 122 of the drawer frame 121 from below. The inner right surface of the main casing 102 (an inner surface rightward of the space S), on the other hand, is formed with a protrusion 174 that is rectangular in cross-section and extending along the front-rear direction. An upper surface of the protrusion 174 is at the same height as the bottom surface (the guide 171) of the groove 173 and serves as the guide 172 for supporting the flange 127 (FIG. 15) of right side plate 123 of the drawer frame 121 from below.

The drawer unit 103 is supported by the guides 171 and 172 with the flanges 126 and 127 being received by the guides 171 and 172 from below, and the drawer unit 103 is movable in this state between an accommodated position in the main casing 102 and a pulled-out position outside the main casing 102 as the flanges 126 and 127 slide on the respective guides 171 and 172.

The color laser printer 101 includes four drive gears (driving power generating members) 175 disposed at fixed intervals in the front-rear direction in the right section of the main casing 102. The four drive gears 175 are disposed slightly leftward of the guide 172 and lower than the guide 172 with an interval between the drive gears 175 and the guide 172 equivalent to a dimension of the drawer frame 121 in the up-down direction, and about upper half sections of the drive gears 175 are exposed in the space S.

As shown in FIG. 20, each drive gear 175 is supplied with driving force from the corresponding motor M disposed in the main casing 102.

The color laser printer 101 includes a control unit 176 having a microcomputer, and the control unit (shutter closing mechanism) 176 controls the motors M.

The drawer frame 121 is provided with a driving force transmitting mechanism 181 for transmitting the driving force, which has been supplied from each motor M to the corresponding drive gear 175, to each developing shutter 145 in a state where the drawer unit 103 is at the accommodated position in the main casing 102.

Figure 21:
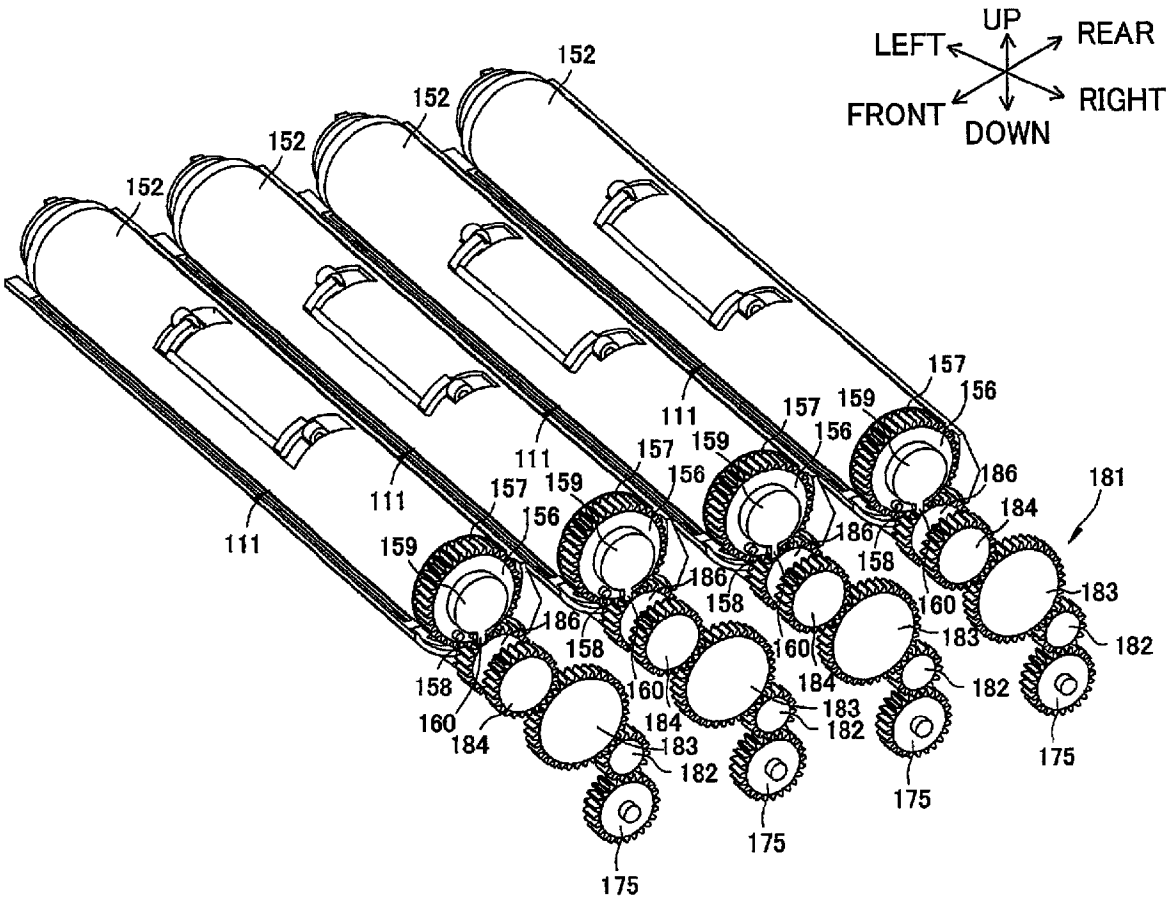
FIG. 21 is a perspective view of a driving force transmitting mechanism of the color laser printer according to the second embodiment of the invention.

As shown in FIG. 21, the driving force transmitting mechanism 181 includes four gear sets provided in one-to-one correspondence with the drive gears 175, each including a first transmission gear (input gear) 182, a second transmission gear 183 in meshing engagement with the first transmission gear 182, a third transmission gear 184 in meshing engagement with the second transmission gear 183, and a fourth transmission gear (output gear) 186. The third transmission gear 184 and the fourth transmission gear 186 are disposed on the same shaft (not shown).

The first transmission gears 182, the second transmission gears 183, and the third transmission gears 184 are disposed outward (rightward) of the right side plate 123 of the drawer frame 121 and rotatably supported to the right side plate 123. The first transmission gears 182 are disposed at the lower end of the right side plate 123, and about lower half sections of the first transmission gears 182 protrude downward beyond the lower edge of the right side plate 123.

The fourth transmission gears 186 are disposed inward (leftward) of the right side plate 123 and rotatably supported to the right side plate 123. As shown in FIGS. 15 and 16, each fourth transmission gear 186 is disposed such that an upper section thereof is exposed upward through a gap between the right side edge of the partitioning wall 143 and the right side plate 123.

The toner cartridges 111 are accommodated into the spaces 112 in the drawer frame 121 from above in a state where the drawer unit 103 (the drawer frame 121) is at the pulled-out position outside the main casing 102.

When the toner cartridge 111 is detached from the space 112, the shutter openings 148 are, as shown in FIG. 22A, located rearward of the openings 144 of the partitioning wall 143, and the outer openings 154 of the outer casing 152 are located rearward of the inner opening 153 of the inner casing 151. That is, the developing shutter 145 is at a closing position for closing the openings 144, and the outer casing 152 is at a closing position for closing the inner opening 153.

In order to insert (mount) the toner cartridge 111 into the space 112, a user first orients the toner cartridge 111 such that the protrusion 160 (FIG. 18) extends downward and that the stopper boss 158 is located opposite to the protrusion 160 in the right-left direction as shown in FIG. 22B (at a position between the protrusion 160 and the right side surface of the inner casing 151 in the right-left direction). Then, the user lowers the toner cartridge 111 into the space 112 from above such that, as shown in FIG. 22B, the protrusion 160 is past the support section 128 and received into the communication port 130 and that the stopper boss 158 is past both the support section 128 and the communication port 130 and placed into the stopper groove 129.

When the toner cartridge 111 is inserted into the space 112 in this manner, then as shown in FIG. 21, the gear teeth 157 formed on the peripheral surface of the right side plate 156 engages with the corresponding fourth transmission gear 186 from above, and the shutter-driving bosses 155 (FIG. 17) of the outer casing 152 engage with the engaging holes 149 (FIG. 15) of the developing shutter 145 from above. In this manner, the outer casing 152 engages with the developing shutter 145.

Then, the drawer unit 103 is moved rearward to the accommodated position in the main casing 102. When the drawer unit 103 reaches the accommodated position, the control unit 176 (FIG. 20) controls the motor M to rotate a prescribed amount in a forward direction. The driving force of the motor M is transmitted to the gear teeth 157 via the drive gear 175, the first transmission gear 182, the second transmission gear 183, the third transmission gear 184, and the fourth transmission gear 186, thereby rotating the right side plate 156 and thus rotating the outer casing 152 together with the developing shutter 145 in the clockwise direction in a right side view. At this time, the inner casing 151 does not rotate because the protrusion 160 of the inner casing 151 is received in the communication port 130 as shown in FIG. 22B.

Figure 23A:
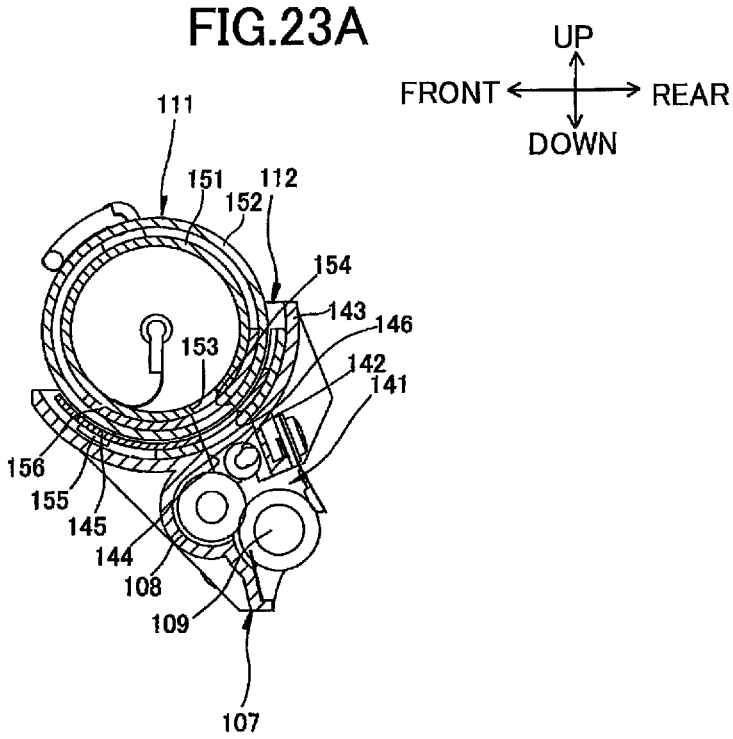
FIG. 23A is a cross-sectional right side view of the developing unit and the toner cartridge with the outer casing at an opening position according to the second embodiment of the invention.

As a result, as shown in FIG. 23A, the shutter openings 148 of the developing shutter 145 and the outer openings 154 of the outer casing 152 overlap with the openings 144 of the partitioning wall 143 and the inner opening 153 of the inner casing 151, so the interior of the inner casing 151 fluidly communicates with the developing chamber 141 through the inner opening 153, the outer openings 154, the shutter openings 148, and the openings 144. That is, the outer casing 152 is at an opening position with respect to the inner casing 151 for opening the inner opening 153 of the inner casing 151.

Figure 23B:
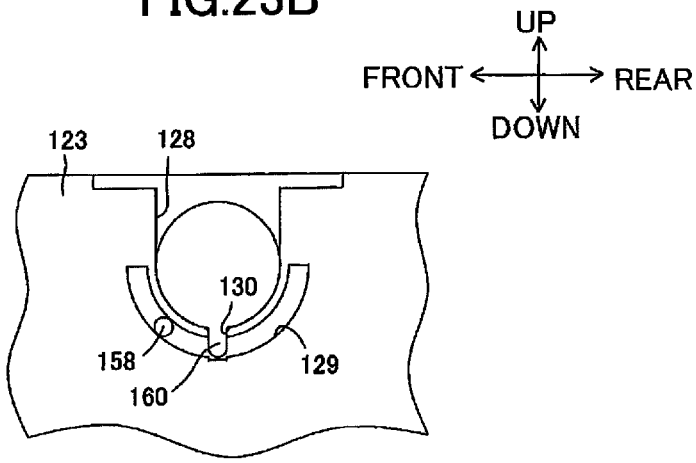
FIG. 23B is an explanatory side view showing a position of the stopper boss with respect to the stopper groove when an inner opening is open.

The rotation of the outer casing 152 moves the stopper boss 158 frontward within the stopper groove 129 as shown in FIG. 23B. As a result, the stopper boss 158 is brought into engagement with the stopper groove 129 at a position frontward of the communication port 130, and up-down movement of the stopper boss 158 is prevented. Accordingly, the toner cartridge 111 cannot be detached from the drawer frame 121 in this condition.

When remaining amount of toner in the inner casing 151 of one of the toner cartridges 111 becomes low after image forming operations are repeatedly performed (when a toner empty condition is detected), then the control unit 176 controls the motor M corresponding to this toner cartridge 111 to rotate a prescribed amount in a reverse direction. The driving force generated by this motor M is transmitted to the gear teeth 157 via the drive gear 175, the first transmission gear 182, the second transmission gear 183, the third transmission gear 184, and the fourth transmission gear 186, thereby rotating the right side plate 156 and thus rotating the outer casing 152 together with the developing shutter 145 in the counterclockwise direction in a right side view. At this time, the inner casing 151 does not rotate because the protrusion 160 is received in the communication port 130.

As a result, as shown in FIG. 22A, the developing shutter 145 closes the openings 144, and the outer casing 152 closes the inner opening 153.

The configuration of this second embodiment provides the similar effects as that of the first embodiment.

While the invention has been described in detail with reference to the embodiments thereof, it would be apparent to those skilled in the art that various changes and modifications may be made therein without departing from the spirit of the invention.

What is claimed is:

1. An image forming device comprising:

a main casing;

a support member movable in a predetermined direction relative to the main casing between an accommodated position within the main casing and a pulled-out position outside the main casing;

a plurality of image bearing members supported on the support member and aligned in a line at intervals in the predetermined direction;

a plurality of developing units supported on the support member and provided in one-to-one correspondence with the plurality of image bearing members;

a plurality of toner cartridges provided in one-to-one correspondence with the plurality of developing units and detachably mounted on the support member, wherein each toner cartridge includes a casing formed with an opening through which toner accommodated in the casing is supplied to the corresponding developing unit and a shutter movable between an opening position at which the shutter opens the opening and a closing position at which the shutter closes the opening;

a plurality of shutter driving members provided in one-to-one correspondence with the plurality of toner cartridges, wherein each of the shutter driving members moves the corresponding shutter between the opening position and the closing position when supplied with a driving force;

a driving force generating member that is disposed in the main casing and that generates the driving force when the support member moves between the accommodated position and the pulled-out position; and a driving force transmitting mechanism that is disposed on the support member and that transmits the driving force generated by the driving force generating member to the shutter driving members to move each corresponding shutter between the opening position and the closing position.

2. The image forming device according to claim 1, wherein:

the support member includes a pair of side plates extending in the predetermined direction and confronting with each other with the image bearing members and the developing units interposed therebetween;

the shutter driving members are disposed to the pair of side plates; and the driving force transmitting mechanism is disposed outside the pair of side plates.

3. The image forming device according to claim 1, wherein the driving force transmitting mechanism is a gear train including a rotatable input gear and a rotatable output gear.

4. The image forming device according to claim 1, wherein the driving force generating member is a rack gear extending in the predetermined direction and generates the driving force as the support member moves between the accommodated position and the pulled-out position.

5. The image forming device according to claim 1, wherein the driving force transmitting mechanism is a gear train including one input gear and a plurality of output gears provided in one-to-one correspondence with the plurality of shutter driving members.

6. The image forming device according to claim 5, wherein each of the shutter driving members is rotatably disposed on the support member and includes a sector gear that engages with the corresponding output gear within a predetermined rotation angle range.

7. The image forming device according to claim 1, wherein the driving force transmitting mechanism is a gear train including a plurality of output gears provided in one-to-one correspondence with the plurality of shutter driving members and a plurality of input gears provided in one-to-one correspondence with the output gears.

8. The image forming device according to claim 1, wherein each of the shutter driving members is formed with a groove extending straight, and each of the toner cartridges is formed with a protrusion that engages with the groove.

9. The image forming device according to claim 8, wherein the protrusion protrudes from the toner cartridge.

10. The image forming device according to claim 8, wherein:

the protrusion is movable between a restricting position and an allowing position;

the protrusion is at the restricting position when the shutter is at the opening position;

the protrusion is at the allowing position when the shutter is at the closing position;

the support member is formed with a plurality of stoppers; and each of the stoppers is opposite to the protrusion of the corresponding toner cartridge when the protrusion is at the restricting position, thereby preventing detachment of the protrusion from the groove.

11. The image forming device according to claim 1, wherein:

the support member includes a pair of side plates extending in the predetermined direction and confronting with each other with the image bearing members and the developing units interposed therebetween;

the shutter driving members are disposed inside the pair of side plates; and the driving force transmitting mechanism is disposed outside the pair of side plates.

12. An image forming device comprising:

a main casing;

a moving member movable in a predetermined direction relative to the main casing between an inside position within the main casing and an outside position outside the main casing, the moving member holding a plurality of developing units aligned in a line at intervals in the predetermined direction;

a plurality of toner cartridges provided in one-to-one correspondence with the plurality of developing units and detachably mounted on the moving member, wherein each of the toner cartridges includes a casing formed with an opening through which toner accommodated in the casing is supplied to a corresponding one of the developing units and a shutter movable between an opening position at which the shutter opens the opening and a closing position at which the shutter closes the opening;

a plurality of shutter driving members provided in one-to-one correspondence with the plurality of toner cartridges, wherein each of the shutter driving members moves the corresponding shutter between the opening position and the closing position when supplied with a driving force;

a driving force generating member that is disposed in the main casing and that generates the driving force when the moving member moves between the inside position and the outside position; and a driving force transmitting mechanism that is disposed on the moving member and that transmits the driving force generated by the driving force generating member to the shutter driving members to move each corresponding shutter between the opening position and the closing position.

* * * * *